United States Patent [19]

Yamane et al.

[11] Patent Number: 4,886,999

[45] Date of Patent: Dec. 12, 1989

[54] CATHODE RAY TUBE APPARATUS WITH QUADRUPOLE ELECTRODE STRUCTURE

[75] Inventors: Hisakazu Yamane; Ritsuo Ishida; Hisao Nakanishi; Keiji Yanai; Masayuki Toshiyasu, all of Nagaokakyo; Kazunori Ikegami; Soichiro Okuda, both of Amagasaki; Kenji Kimura, Nagaokakyo; Koji Ishibata, Nagaokakyo; Yoshinori Ishii, Nagaokakyo, all of Japan

[73] Assignee: Mitsubishi Denki Kabushiki Kaishi, Tokyo, Japan

[21] Appl. No.: 295,883

[22] Filed: Jan. 11, 1989

Related U.S. Application Data

[63] Continuation of Ser. No. 34,021, Apr. 3, 1987, abandoned.

[30] Foreign Application Priority Data

| | | | |
|---|---|---|---|
| Apr. 3, 1986 | [JP] | Japan | 61-77057 |
| Apr. 3, 1986 | [JP] | Japan | 61-77058 |
| Apr. 3, 1986 | [JP] | Japan | 61-77056 |
| Apr. 8, 1986 | [JP] | Japan | 61-82629 |
| Apr. 8, 1986 | [JP] | Japan | 61-82625 |
| Apr. 8, 1986 | [JP] | Japan | 61-82626 |
| Apr. 8, 1986 | [JP] | Japan | 61-82627 |
| Apr. 8, 1986 | [JP] | Japan | 61-82623 |
| Apr. 8, 1986 | [JP] | Japan | 61-82624 |
| Apr. 28, 1986 | [JP] | Japan | 61-100624 |
| Apr. 30, 1986 | [JP] | Japan | 61-102793 |
| Jun. 18, 1986 | [JP] | Japan | 61-142401 |
| Jun. 24, 1986 | [JP] | Japan | 61-148941 |
| Sep. 3, 1986 | [JP] | Japan | 61-208408 |
| Sep. 16, 1986 | [JP] | Japan | 61-218582 |
| Sep. 25, 1986 | [JP] | Japan | 61-228731 |
| Feb. 18, 1987 | [JP] | Japan | 62-36271 |

[51] Int. Cl.[4] ..... H01J 29/46

[52] U.S. Cl. ..... 313/414; 313/449; 315/1; 315/14; 315/15; 315/382

[58] Field of Search ..... 313/414, 449; 315/1, 315/8, 5.26, 5.34, 14, 15, 371, 382

[56] References Cited

U.S. PATENT DOCUMENTS

| | | | |
|---|---|---|---|
| 3,949,262 | 4/1976 | Ohkoshi et al. | 313/460 |
| 3,961,223 | 6/1976 | Ray et al. | 315/371 |
| 4,388,619 | 6/1983 | Beck | 315/371 |
| 4,626,738 | 12/1986 | Gerlach | 313/414 |
| 4,701,677 | 10/1987 | Ashizaki et al. | 315/15 |
| 4,772,827 | 9/1988 | Osakabe et al. | 313/414 |
| 4,814,670 | 3/1989 | Suzuki et al. | 315/15 |

FOREIGN PATENT DOCUMENTS

| | | | |
|---|---|---|---|
| 0235975 | 2/1987 | European Pat. Off. . | |
| 897226 | 8/1943 | France . | |
| 53-9464 | 1/1978 | Japan | 313/414 |
| 54-114175 | 6/1979 | Japan . | |
| 56-128551 | 10/1981 | Japan . | |
| 61-39347 | 2/1986 | Japan . | |
| 61-250933 | 2/1986 | Japan . | |
| 61-47040 | 3/1986 | Japan . | |

*Primary Examiner*—James J. Groody
*Assistant Examiner*—Mark R. Powell
*Attorney, Agent, or Firm*—Birch, Stewart, Kolasch & Birch

[57] ABSTRACT

A cathode ray tube apparatus comprises three cathodes arranged in line with each other in a first direction for emission of respective electron beams therefrom, a focusing electrode having first to third apertures defined therein for the passage of the respective electron beams therethrough, a quadrupole electrode structure including first to third quadrupole electrodes one for each electron beam, each of the quadrupole electrode being comprised of a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam, and a power source circuit for applying a predetermined voltage to the quadrupole electrode structure.

58 Claims, 19 Drawing Sheets

Fig. 3 Prior Art
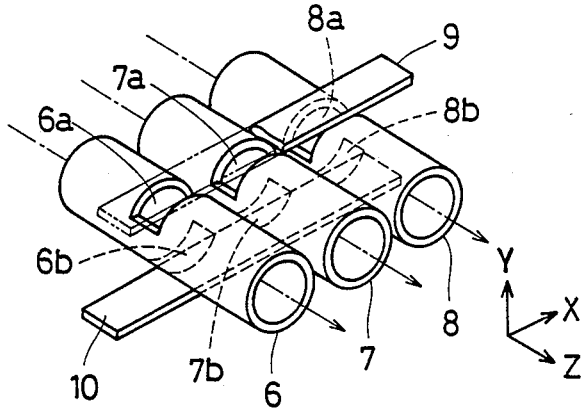
Fig. 4 (a) Prior Art
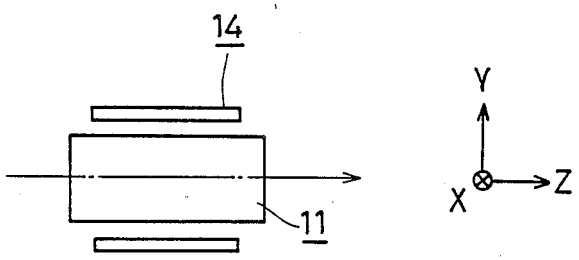
Fig. 4 (b) Prior Art
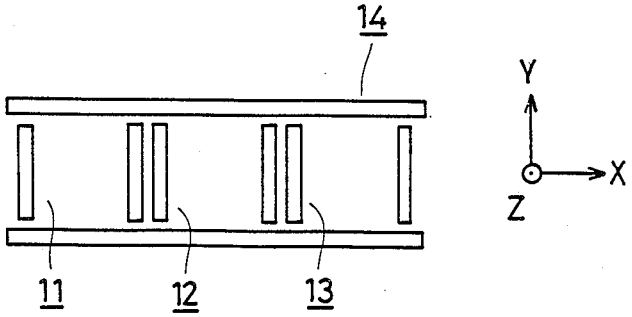

| | When Static | When Potential of Horijontal Electrode Pieces is Higher Than That of Vertical Electrode Pieces | | Overall Results |
|---|---|---|---|---|
| | | Actions of Electrodes 17 & 19 | Action of Principal Lens | |
| Focus | 22b, 22a, 22b, 22 | 22a, 22b | 22a, 22b | 21 |
| Convergence | 21 | R G B | B G R | 21 |

CATHODE RAY TUBE APPARATUS WITH QUADRUPOLE ELECTRODE STRUCTURE

This application is a continuation of application Ser. No. 034,021, filed on Apr. 3, 1987, now abandoned.

BACKGROUND OF THE INVENTION

1. Field of Technology

The present invention relates to a cathode ray tube apparatus for use in a television receiver set, a television monitor, or a computer display device.

2. Description of the Prior Art

Some typical prior art cathode ray tubes to which the present invention pertains will be discussed with the aide of FIGS. 1 to 4 of the accompanying drawings.

FIG. 1 illustrates, in horizontal sectional view, an in-line electron gun assembly used in one prior art cathode ray tube and mounted in the neck region thereof. The illustrated beam-producing electron gun assembly comprises three cathodes 1 disposed in in-line fashion in a horizontal direction (hereinafter referred to as "X-axis") perpendicular to the longitudinal axis Y of the cathode ray tube, which cathodes 3 constitute, together with a common control electrode or grid 2 and an accelerating electrode or grid 3, a front stage electrode triad. The electron gun assembly also comprises an anode 5 and a focusing electrode 4 positioned between the electrode triad and the anode 5.

The prior art cathode ray tube utilizing the above described electron gun assembly operates in the following manner. In order to eliminate the necessity of using a dynamic convergence circuit, an electron beam deflecting system used in the prior art cathode ray tube makes use of a self-convergence deflection yoke capable of distorting a horizontal deflection magnetic field so as to represent a pincushion pattern and also distorting a vertical deflection magnetic field so as to represent a barrel-shaped pattern. Therefore, some of the spots of electron beams cast on the phosphor screen of the cathode ray tube, which are located adjacent a peripheral area of the phosphor screen, tend to represent a generally oval or elliptical shape as shown in FIG. 2. This distortion of the electron beam spots results in a considerable reduction in resolution of a picture being reproduced on the viewing screen of the cathode ray tube particularly at the peripheral area thereof. In order to substantially eliminate the considerable reduction in resolution of the picture being reproduced, it is usual for the prior art cathode ray tube to have a so-called dynamic focusing system wherein a focusing voltage Vf to be applied to the focusing electrode 4 is superimposed with a modulating voltage Em which varies so as to increase at the peripheral area of the phosphor screen in synchronism with a horizontal deflection frequency, thereby to compensate for distortion in shape of the electron beam spots. In other words, correction of the oval or elliptical shape of the electron beam spots to a circular shape presented in a central area of the viewing screen as shown in FIG. 2 is carried out.

It has, however, been found that, although the use of the dynamic focusing system referred to above improves the resolution of the picture being reproduced on the viewing screen of the cathode ray tube, particularly that of the peripheral area of the reproduced picture, the convergence of the principal electron lens formed between the anode 5 and the focusing electrode 4 tends to vary with modulation of the focusing voltage Vf, resulting in a misconvergence in which, of the three electron beams of different colors (for example, red, green and blue), two electron beams of green and blue colors traveling on respective side of the electron beam of red color diverge laterally outwardly therefrom.

On the other hand, in order to render the respective spots of the electron beams impinging upon the peripheral area of the viewing screen to be circular in shape, an electron gun assembly has been proposed wherein electrodes forming a quadrupole electrode structure are disposed inside an electron gun assembly so that the trajectories of the electron beams traveling towards the viewing screen can be corrected electrostatically.

By way of example, the Japanese Laid-open Pat. No. 53-9464published Jan. 27, 1978, discloses the electron gun assembly of the type referred to above and as shown. FIG. 3 illustrates in a partially exploded view, a quadrupole electrode structure used in this prior art electron gun assembly for forming a quadrupole lens. Referring to FIG. 3, the quadrupole electrode structure comprises three cylindrical electrodes 6, 7 and 8 arranged in side-by-side relationship in a horizontal direction X, each of said cylindrical electrodes 6 to 8 having vertically upwardly and downwardly oriented openings 6*a* and 6*b*, 7*a* and 7*b*, 8*a* 8*b*, defined therein. The electron gun assembly shown therein also comprises electrode strips 9 and 10 positioned and supported so as to traverse immediately above the openings 6*a*, 7*a* and 8*a* and below the openings 6*b*, 7*b* and 8*b*, respectively, so that electromagnetic field developed inside each of the openings 6*a* to 8*a* of the respective cylindrical electrodes 6 to 8 can form an electromagnetic quadrupole electrode assembly.

The electrode structure disclosed in the Japanese Laid-open Patent Publication No. 53-9464 has been found difficult to assembly into a unitary structure and has also been found to be complicated and time-consuming to fabricate. Moreover, since the electrode strips 9 and 10 positioned on respective sides of the cylindrical electrodes 6 to 8 in parallel relation to each other are utilized as respective electrodes common to all of the cylindrical electrodes 6 to 8, the misconvergence tends to occur depending on the voltage applied between the cylindrical electrodes 6 to 8, with the consequence that the convergence characteristic tends to be impaired.

The electron gun assembly utilizing the quadrupole electrode structure is also disclosed in the Japanese Laid-open Patent Publication No. 61-39347 published Feb. 26, 1986. This electron gun assembly is shown in FIGS. 4(*a*) and 4(*b*) in schematic side view and in schematic front elevational view, respectively. This electron gun assembly includes a quadrupole electrode structure which is defined by a pair of vertical electrode pieces 11, 12 or 13 spaced apart from each other and positioned on respective side of the path of travel of the respective electron beam, and a pair of horizontal electrode pieces 14 common to all of the pairs of the vertical electrode pieces 11 to 13 and positioned immediately above and below the pairs of the horizontal electrode pieces 11 to 13.

The quadrupole electrode structure used in the electron gun assembly according to the Japanese Laid-open Patent Publication No. 61-39347 has a problem similar to that inherent in the quadrupole electrode structure shown in and described with reference to FIG. 3 since the pair of the horizontal electrode pieces 14 are utilized for all of the electron beams.

SUMMARY OF THE INVENTION

Accordingly, the present invention has for its essential object to provide a cathode ray tube apparatus wherein an improved quadrupole electrode structure effective to substantially eliminate the deflection aberration is employed thereby to substantially obviate the problems inherent in the prior art cathode ray tube.

In order to accomplish this object of the present invention, the cathode ray tube apparatus according to one preferred embodiment of the present invention comprises first to third cathodes arranged in line with each other in a first direction for emission of respective electron beams therefrom, a focusing electrode having first to third apertures defined therein for the passage of the respective electron beams therethrough, one quadrupole electrode structure including first to third quadrupole electrodes one for each electron beams, each of said quadrupole electrode being comprised of a pair of horizontal electrode pieces positioned upwardly and downwardly, respectively, with respect to the associated electron beam, and a pair of vertical electrode pieces positioned leftwards and rightwards with respect to such associated electron beam, and a power source circuit for applying a predetermined voltage to the quadrupole electrode structure.

According to another preferred embodiment of the present invention, the cathode ray tube apparatus comprises at least one cathode, a first focusing electrode positioned next to the cathode in alignment with the cathode, a second focusing electrode positioned on one side of the first focusing electrode remote from the cathode in alignment with the first focusing electrode, a quadrupole electrode structure positioned between the first and second focusing electrodes in alignment therewith and including at least one quadrupole electrode having a horizontal electrode member and a vertical electrode member, and a power source circuit for applying a predetermined focusing voltage to both of the first and second focusing electrodes and also for applying a modulating voltage between the horizontal electrode member and the vertical electrode member of the quadrupole electrode, said modulating voltage being synchronized with a deflection period.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more clearly understood from the following description of preferred embodiments, when taken in conjunction with the accompanying drawing. However, the embodiments and the accompanying drawings are given only for the purpose of illustration and explanation, and are not to be taken as being limitative of the present invention in any way whatsoever, whose scope is to be determined solely by the appended claims. In the accompanying drawings, like reference numerals denote like parts in the several views, and:

FIG. 3 is a partially exploded view of the prior art quadrupole electrode structure;

FIG. 4(*a*) and 4(*b*) are schematic side and front elevational views, respectively, of the different prior art quadrupole electrode structure;

DETAILED DESCRIPTION OF THE PREFERRED EMBODIMENTS

Figure 5:
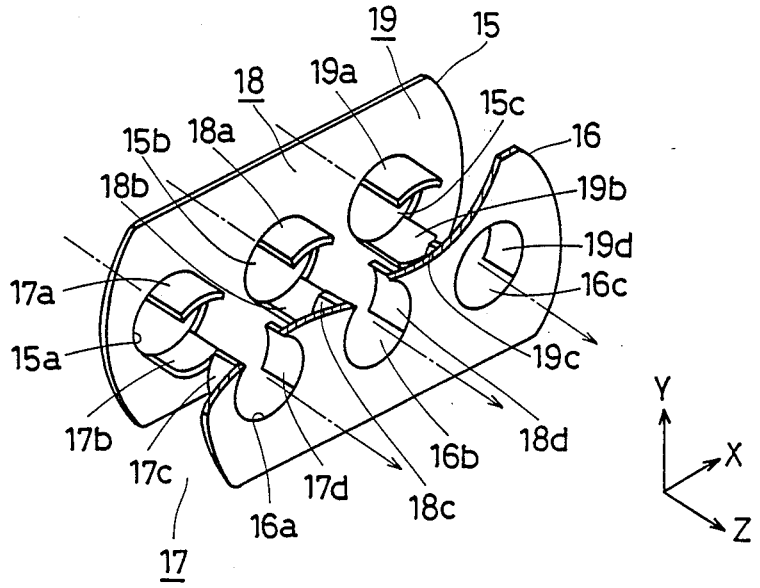
FIG. 5 is an exploded view of a quadrupole electrode structure according to a first preferred embodiment of the present invention.

Referring first to FIG. 5, a quadrupole electrode structure according to a first preferred embodiment of the present invention shown therein is for use in a beam-producing electron gun assembly having three in-line electron guns and comprises generally rectangular first and second base plates 15 and 16 spaced a distance from each other and held in parallel relationship with each other. The first base plate 15 has three apertures 15*a*, 15*b* and 15*c* defined therein in side-by-side fashion in a direction lengthwise of the first base plate 15 and also has, for each aperture 15*a*, 15*b* or 15*c*, a pair of arcuate horizontal electrode pieces 17*a* and 17*b*, 18*a* and 18*b*, 19*a* and 19*b* formed integrally with the first base plate 15 so as to protrude in a direction facing the second base plate 16 from the peripheral lip region around the respective aperture 15*a*, 15*b* or 15*c*, said horizontal arcuate electrode pieces 17*a* and 17*b*, 18*a* and 18*b*, 19*a* and 19*b* of each pair being spaced 180 degrees from each other about the center of the associated aperture 15*a*, 15*b* or 15*c*.

The second base plate 16 is of a construction substantially similar to the first base plate 16 and has three apertures 16*a*, 16*b* and 16*c* defined therein in side-by-side fashion in a direction lengthwise of the second base plate 16. This second base plate 16 also has, for each aperture 16*a*, 16*b* or 16*c*, a pair of arcuate vertical electrode pieces 17*c* and 17*d*, 18*c* and 18*4*, 19*c* and 19*d* formed integrally with the second base plate 15 so as to protrude in a direction facing the first base plate 15 from the peripheral lip region around the respective aperture 16*a*, 16*b* or 16*c*. The arcuate vertical electrode pieces 17*c* and 17*d*, 18*c* and 18*d*, 19*c* and 19*d* of each pair are spaced 180 degrees from each other about the center of the associated aperture 16*a*, 16*b* or 16*c*, but are circumferentially offset 90 degrees relative to the associated horizontal electrode pieces 17*a* and 17*b*, 18*a* and 18*b*, 19*a* and 19*b* in the first base plate 15.

Thus, when the first and second base plates 15 and 16 are combined together with the apertures 15*a* to 15*c* in the first base plate 15 aligned with the apertures 16*a* to 16*b* in the second base plate 16, respectively, the arcuate horizontal and vertical electrode pieces 17*a* to 17*d* are alternately positioned so as to assume the shape generally similar to a barrel coaxial with the mating apertures 15*a* and 16*a*, thereby forming a first quadrupole electrode assembly 17. Similarly, the arcuate horizontal and vertical electrode pieces 18*a* to 18*d* as well as the arcuate horizontal and vertical electrode pieces 19*a* to 19*d* are alternately positioned so as to assume the shape generally similar to a barrel coaxial with the mating apertures 15*b* and 16*b* and with the mating apertures 15*c* and 16*c*, respectively, thereby forming second and third quadrupole electrode assemblies 18 and 19.

Figure 6:
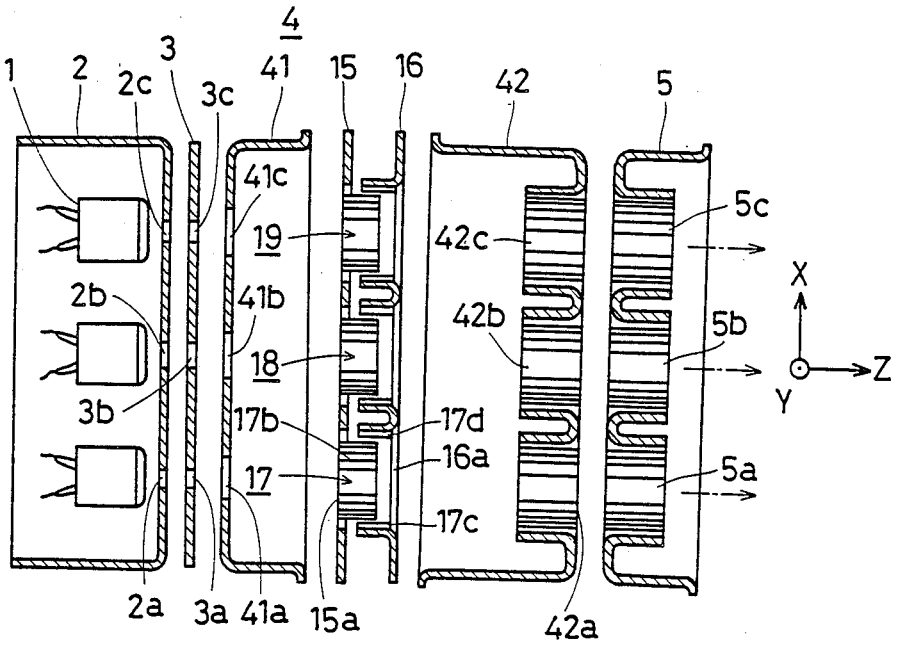
FIG. 6 is a horizontal sectional view of an electron gun assembly utilizing the quadrupole electrode structure shown in FIG. 5.

Referring now to FIG. 6, the in-line beam-producing electron gun assembly shown therein comprises three cathodes 1 enclosed by a control electrode 2 having apertures 2*a* to 2*c* defined therein in alignment with the respective cathodes 1, an accelerating electrode 3 having apertures 3*a* to 3*c* defined therein, a focusing electrode 4 positioned on one side of the accelerating electrode 3 remote from the control electrode 2, and an anode 5 having apertures 5*a* to 5*c* defined therein and positioned on one side of the focusing electrode 4 remote from the accelerating electrode 3. As shown, the focusing electrode 4 is divided into pre-focusing and post-focusing electrode units 41 and 42 which are spaced a distance from each other and have respective apertures 41*a* 41*c* and 42*a* to 42*c* defined therein, and the quadrupole electrode structure shown in and described with reference to FIG. 5 is positioned between the pre-focusing and post-focusing electrode units 41 and 42.

As a matter of design, all of the electrodes 2, 3, 41, 15, 16, 42 and 5 of the electron gun assembly are so arranged and so positioned that the apertures 3*a* to 3*c*, the apertures 41*a* to 41*c*, the apertures 15*a* to 15*c*, the apertures 16*a* to 16*c*, the apertures 42*a* to 42*c*, and the apertures 5*a* to 5*c* can be axially aligned with each other while each neighboring member is spaced a predetermined distance from each other. These electrodes of the electron gun assembly are in practice connected together by means of bead glass and enclosed in the neck region of the cathode ray tube.

The beam-producing electron gun assembly of the construction described above can be fabricated by the use of a mandrel assembly on which the electrodes 2, 3, 41, 15, 16, 42 and 5 are mounted with all of the apertures 3*a* to 3*c*, 41*a* to 41*c*, 15*a* to 15*c*, 16*a* to 16*c*, 42*a* to 42*c* and 5*a* to 5*c* aligned axially with one another, respectively, while each neighboring member of the electrodes 2, 3, 41, 15, 16, 42 and 5 is spaced a predetermined distance from each other by the use of a respective plate-like spacer (not shown), the assembly being in turn fixed in position by means of the bead glass.

Figure 7:
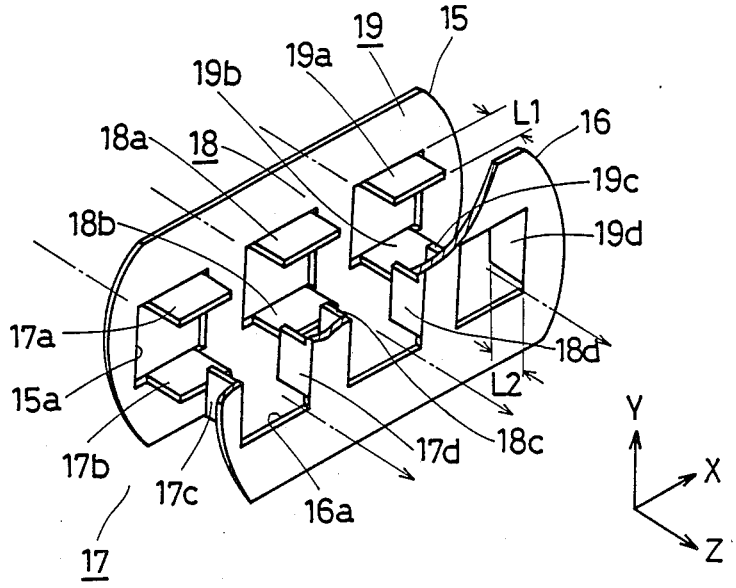
FIG. 7 is an exploded view of the quadrupole electrode structure according to a second preferred embodiment of the present invention.

While each of the apertures 15*a* to 15*c* and 16*a* to 16*c* defined in the first and second base plates 15 and 16, respectively, is circular in shape and, consequently, each of the horizontal and vertical electrode pieces for each quadrupole electrode 17, 18, and 19 represents an arcuate cross-sectional shape conforming to the curvature of the associated aperture, it may be square in shape as shown in FIG. 7 which illustrates a second preferred embodiment of the present invention.

Referring to FIG. 7, each of the apertures 15*a* to 15*c* and 16*a* to 16*c* in the first and second base plates 15 and 16 being square in shape has each side of a length selected to be equal to the diameter of each of the apertures 15*a* to 15*c* and 16*a* to 16*c* shown in FIG. 5.

Since each of the quadrupole electrodes 17 to 19 shown in FIG. 7 can be formed by making a generally H-shaped slit in a plate, which will be eventually used as any one of the base plates 15 and 16, and bending opposite positions delineated by the H-shaped slit so as to protrude in a direction perpendicular to the plane of the plate thereby to complete the opposite electrode pieces 17*a* and 17*b*, 18*a* and 18*b*, 19*a* and 19*b*, or 17*c* and 17*d*, 18*c* and 18*d*, 19*c* and 19*d*. In this case, each of the horizontal and vertical electrode pieces are substantially in the form of a flat plate. Therefore, according to the second preferred embodiment, the quadrupole electrode structure can be precisely fabricated by the use of any known press work.

The electron gun assembly utilizing the quadrupole electrode structure shown in FIG. 7 can also be fabricated in a manner similar to that according to the first preferred embodiment. More specifically, since each of the apertures in each of the base plates 15 and 16 is of the square shape, each side of which is of a length equal to the diameter of each of the apertures in each of the base plates 15 and 16 used in the first preferred embodiment shown in and described with reference to FIGS. 5 and 6, the same mandrel assembly as used in the fabrication of the electron gun assembly shown in FIG. 6 can be utilized.

Figure 8:
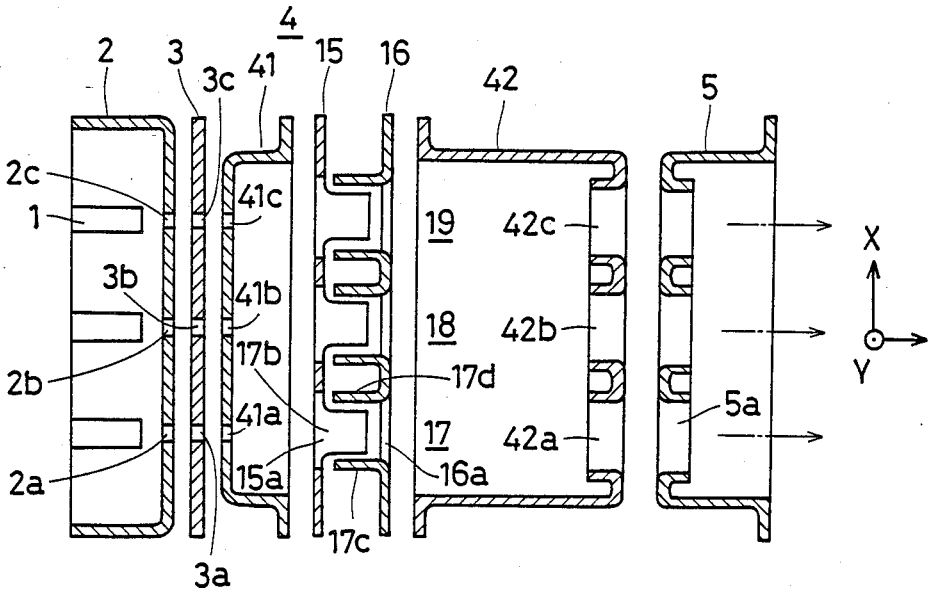
FIG. 8 is a horizontal sectional view of the electron gun assembly utilizing the quadrupole electrode structure shown in FIG. 7.

FIG. 8 is a view similar to FIG. 6, but showing the quadrupole electrode structure described with reference to FIG. 7 in relation to the other electrodes.

Figure 9:
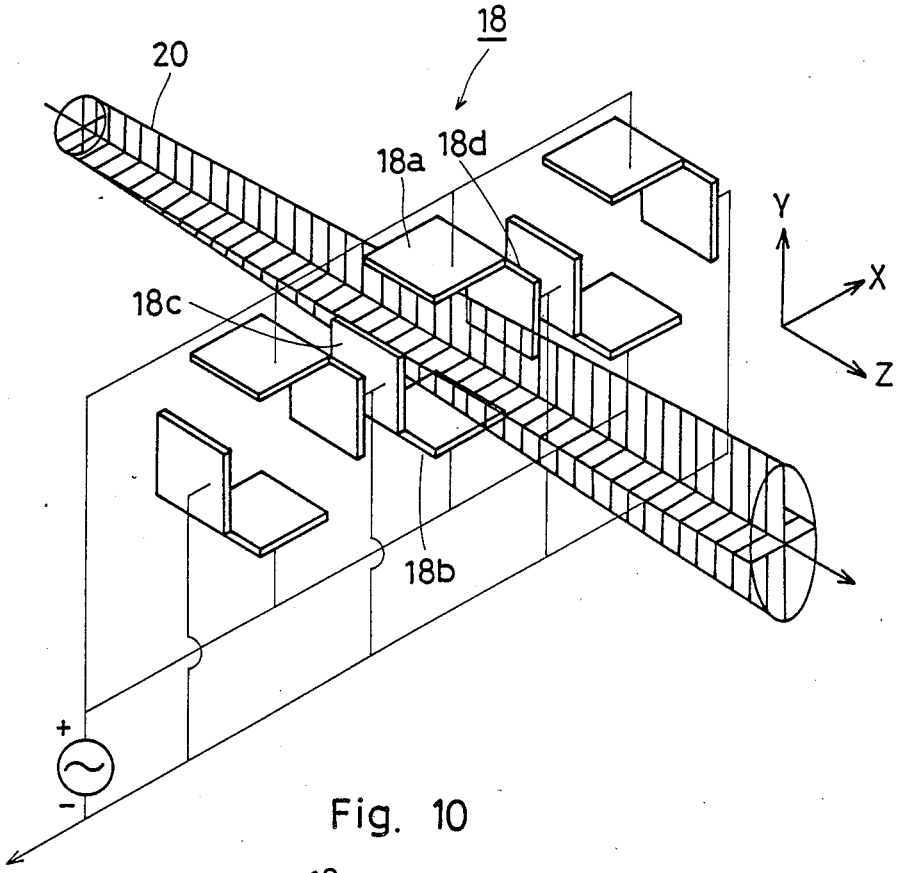
FIG. 9 is a schematic perspective view of the quadrupole electrode structure used to explain the function thereof.

FIG. 9 illustrates a diagram used to explain the function of each of the quadrupole electrodes 17, 18 and 19 disposed in a drift space between the pre-focusing and post-focusing electrode units 41 and 42 in the beam-producing electron gun assembly utilizing the quadrupole electrode structure shown in any of FIGS. 5 and 6 and FIGS. 7 and 8. The flow of electrons emitted from each cathode 1 forms an electron beam 20 after having been adjusted during their passage through a space between the associated aperture 2*a*, 2*b* or 2*c* in the control electrode 2 and the associated aperture 3*a*, 3*b* or 3*c* in the accelerating electrode 3, which beam 20 in turn travels through the associated aperture 41*a*, 41*b* or 41*c* in the pre-focusing electrode unit 41, then the associated quadrupole electrode 17, 18 or 19, the associated aperture 42*a*, 42*b* or 42*c* in the post-focusing electrode unit 42, and finally associated aperture 5*a*, 5*b* or 5*c* in the anode 5 towards the phosphor screen (not shown). During the travel of the electron beam from the anode 5 towards the phosphor screen, it is converged so as to form a spot on the phosphor screen when it subsequently impinges upon the phosphor screen.

It is to be noted that the pre-focusing and post-focusing electrode units 41 and 42 forming the focusing electrode 4 are electrically connected together and are held at the same potential, so that the electron beam drifts.

In describing the function of each of the quadrupole electrodes 17 to 19, reference will be made to only one of them, for example, the quadrupole electrode 18, since all of them are substantially identical in structure and function.

As shown in FIG. 9, when a positive potential is applied from the vertical electrode pieces 18*c* and 18*d* to the horizontal electrode pieces 18*a* and 18*b*, the electron beam 10 which is circular in cross-sectional representation at the time it enters the respective quadrupole electrode 18 is affected by a force of attraction, induced by the developed electrostatic field and acting in a vertical direction Y, during its passage through the respective quadrupole electrode 18 so as to assume a generally elliptical cross-section with its long axis lying parallel to the vertical direction Y so that the cross-sectional representation of the electron beam can, during the subsequent passage of the electron beam through a magnetic field developed by the deflection system, be compensated for thereby to substantially eliminate, before the electron beam 20 is actually deflected, any possible aberration. That is, a deflection aberration wherein the electron beam may, when impinging upon the phosphor screen of the cathode ray, represent a generally elliptical shape with its long axis lying parallel to the horizontal direction X. Where the spot is to be cast on a central area of the phosphor screen, however, no correction of the cross-sectional representation of the electron beam 20 which is carried out by the respective quadrupole electrode 18 is effected, and, in dependence on the amount of deflection of the electron beam 20, a focusing voltage for correction purpose having a waveform effective to cause the electron beam to form a generally circular spot on the phosphor screen is applied to progressively vary the cross-sectional representation of the electron beam 20.

Since this function takes place in the drift space, the electron beam will be neither accelerated nor decelerated and converging performance of the electron gun assembly will not be adversely affected.

Figure 10:
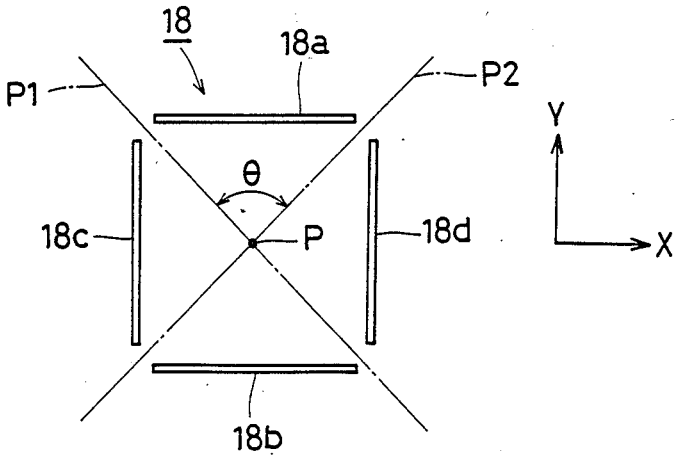
FIG. 10 is a schematic diagram showing horizontal and vertical electrode pieces forming each quadrupole electrode, which is used to illustrate a geometric arrangement thereof.

The four electrode pieces 18*a* to 18*d* forming the quadrupole electrode 18 are, as shown in FIG. 10, so arranged and so positioned that the paired electrode pieces 18*a* and 18*b* and the paired electrode pieces 18*c* and 18*d* can form respective electric fields in the vertical and horizontal directions, respectively, while the angle $\theta$ formed between a diagonal plane P1, which extends through an intermediate point in a space between the neighboring electrode pieces 18*a* and 18*c* and also through an intermediate point in a space between the neighboring electrode pieces 18*b* and 18*d*, and a diagonal plane P2 which extends through an intermediate point in a space between the neighboring electrode pieces 18*a* and 18*d* and also through an intermediate point in a space between the neighboring electrode pieces 18*c* and 18*d* and which lies at right angles to the diagonal plane P1 can fall with the range of 85 to 90 degrees, preferably 90 degrees, with the line of intersection P between the diagonal planes P1 and P2 lying in register with the longitudinal axis of the quadrupole electrode 18 so that the electron beam 20 traveling towards the phosphor screen can pass in register with this line of intersection P. With this arrangement, the electrostatic fields developed inside the quadrupole electrode 18 are symmetric with respect to the longitudinal axis of the quadrupole electrode 18. The cross-sectional representation of the electron beam 20 passing through the quadrupole electrode 18 merely changes from the circular shape to the elliptical shape with its long axis lying parallel to the vertical direction Y and in no way changes to any other shape. Therefore, the spot image of the electron beam 20 cast upon the phosphor screen can be rendered to be substantially right circular and only the aberration resulting from the deflection can be substantially eliminated.

Although in any one of the foregoing embodiments shown in and described with reference to FIGS. 5 and 6 and FIGS. 7 and 8, the quadrupole electrode structure has been described as positioned between the pre-focusing and post-focusing electrode units 41 and 42, the position of the quadrupole electrode structure may not be limited to such as shown and described.

Each of the quadrupole electrodes 17 to 19 is operable to regulate or correct the cross-sectional shape of the respective electron beam 20 traveling within the interior of the quadrupole electrode 17, 18 or 19 when a voltage necessary to correct the eventual deflection aberration of the electron beam 20 is applied between the horizontal electrode pieces and the vertical electrode pieces constituting such quadrupole electrode. Accordingly, the amount of correction, that is, the extent to which the cross-sectional shape of the electron beam 20 is regulated, is proportional to the voltage so applied between the horizontal and vertical electrode pieces, and to the length L1 of each of the horizontal electrode pieces as well as the length L2 of each vertical electrode pieces. Each of said lengths L1 and L2 is, as indicated in FIG. 7, measured in a direction parallel to the longitudinal axis of the cathode ray tube.

Figure 11:
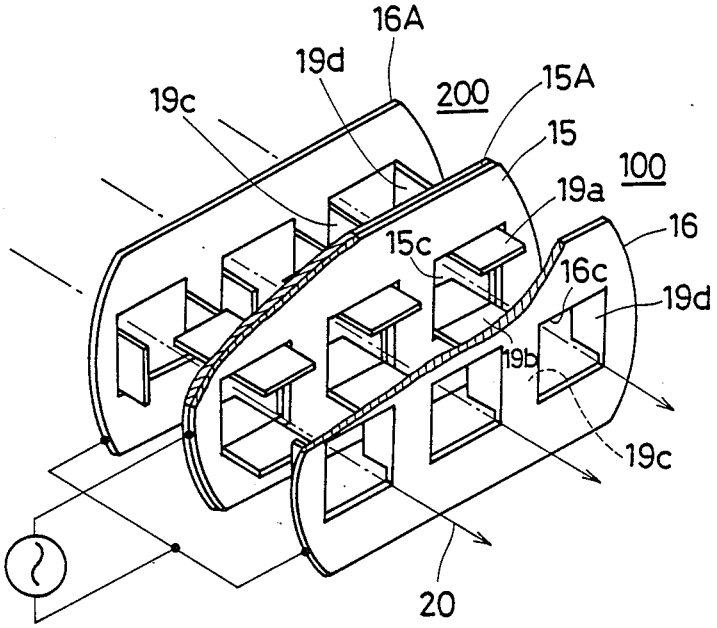
FIG. 11 is a schematic perspective view of the quadrupole electrode structure according to a third preferred embodiment of the present invention.

FIG. 11 illustrates the electron gun assembly utilizing the quadrupole electrode structure according to a third preferred embodiment of the present invention, reference to which will now be made. The quadrupole electrode structure shown therein may be considered as comprised of two units of the quadrupole electrode structures each being of the construction shown in and described with reference to FIG. 7, which units are respectively generally identified by 100 and 200. More specifically, the quadrupole electrode unit 100 is identical with the quadrupole electrode structure shown in and described with reference to FIG. 7, whereas the quadrupole electrode unit 200 includes first and second base plates 15A and 16A which are respectively identical in construction with the first and second base plates 15 and 16. However, the first base plate 15A is connected in back-to-back fashion with the first base plate 15 with the horizontal electrode pieces of the first base plate 15A protruding in a direction away from the first base plate 15 and in opposite sense to the horizontal electrode pieces of the first base plate 15. At the same time, the second base plate 16A is so positioned and so spaced as to have its vertical electrode pieces protruding in a direction facing the vertical electrode pieces integral with the second base plate 16.

Electrically, the first base plates 15 and 15A of the respective quadrupole electrode units 100 and 200 are connected together and the second base plates 16 and 16A of the respective quadrupole electrode units 100 and 200 are connected together, the first base plates 15 and 15A of one quadrupole electrode unit 100 and the second base plates 16 and 16A of the other quadrupole electrode unit 200 being in turn connected with a source of focusing voltage for correction purpose as shown.

Figure 1:
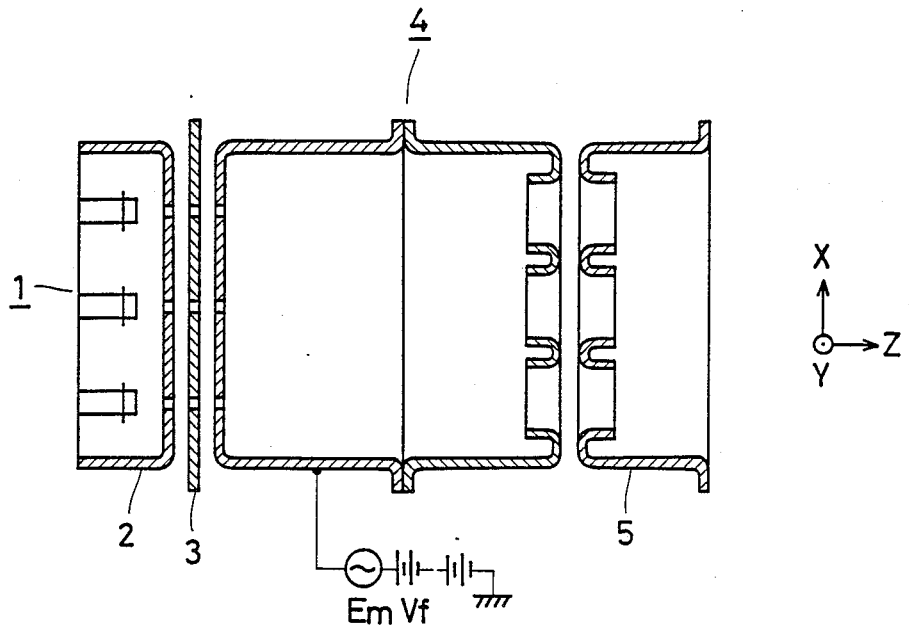
Fig. 1 Prior Art
FIG. 1 is a horizontal sectional view of the prior art in-line beam-producing electron gun assembly used in the cathode ray tube.
Figure 2:
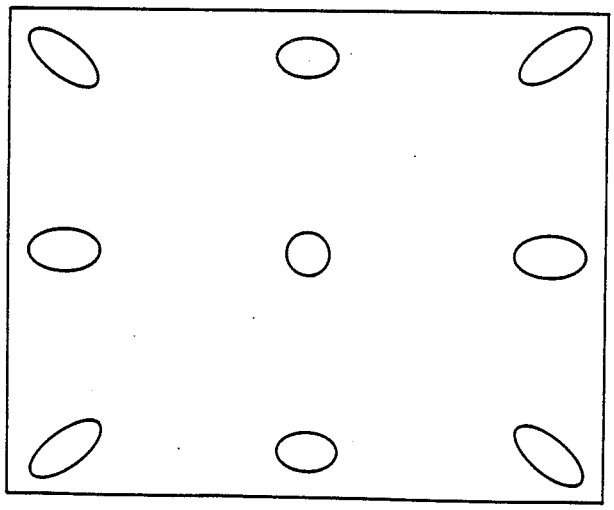
Fig. 2 Prior Art
FIG. 2 is a schematic diagram showing a viewing screen of the cathode ray tube used for the explanation of the manner in which beam spots are formed.

According to the third embodiment shown in and described with reference to FIG. 11, when the focusing voltage for correction purposes is applied between the first base plates 15 and 15A and the second base plates 16 and 16A, more specifically between the horizontal electrode pieces of the first base plates 15 and 15A and the vertical electrode pieces of the second base plates 16 and 16A, it is clear that two quadrupole lenses (one for each quadrupole electrode unit 100 and 200) are formed. Hence each electron beam passing through the respective quadrupole electrode is corrected two times as to the cross-sectional shape thereof. Accordingly, with this construction according to the third embodiment of the present invention, the correction amount necessary to compensate for the eventual deflection aberration may be substantially half that accomplished by any one of the foregoing embodiments. Therefore, in order to achieve the intended purpose, the focusing voltage to be applied to the quadrupole electrode structure shown in FIG. 1 may suffice to be smaller than that required in the quadrupole electrode structure according to any one of the foregoing embodiments. This in turn brings about an advantage in that the focusing power source useable in the third embodiment of the present invention can be rendered to be inexpensive as compared with that required in any one of the foregoing embodiments.

It is to be noted that, in the third preferred embodiment of the present invention, the quadrupole electrode structure has been shown and described as comprised of the two units of the quadrupole electrodes. However, the number of the quadrupole electrode units may not be always limited to two such as shown and described, and, if desired, three or more quadrupole electrode units may be employed. It is also to be noted that, although in the third preferred embodiment the base plates 15 and 15A having the horizontal electrode pieces have been shown and described as joined together and positioned between the base plates 16 and 16A. The base plated 16 and 16A may be joined together in a similar manner and positioned between the base plates 15 and 15A.

Figure 12:
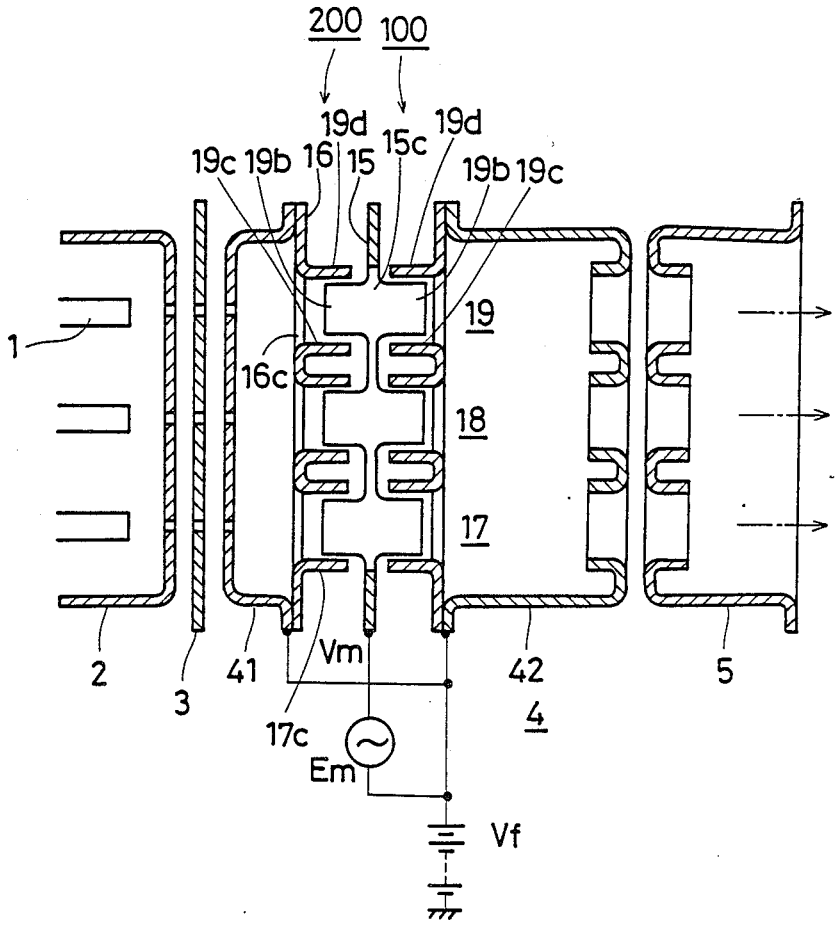
FIG. 12 is a view similar to FIG. 6, showing the quadrupole electrode structure of FIG. 11 used in the electron gun assembly.

The electron gun assembly utilizing the quadrupole electrode structure is shown in FIG. 12 in a horizontal longitudinal sectional representation. As is the case with any one of the foregoing embodiments, the quadrupole electrode structure is interposed between the pre-focusing and post-focusing electrode units 41 and 42.

Figure 13:
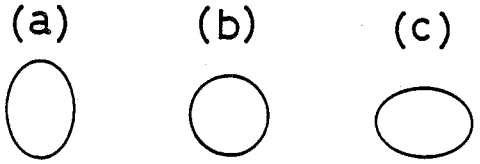
FIG. 13 is a schematic diagram showing electron beam spots of different shapes cast on the phosphor screen of the cathode ray tube.

Referring to FIG. 12, assuming that both of the vertical electrode pieces **17*c* to 19*d* and the focusing electrode 4 are held at the same potential, and when a focusing voltage superimposed with a modulating voltage Em synchronized with a horizontal deflection field developed by the deflection yoke (not shown), that is, a voltage Vf to be applied to both of the vertical electrode pieces 17*c* to 19*d* and the focusing electrode 4, is applied to the horizontal electrode pieces 17*a* to 19*b*, two quadrupole lenses can be formed inside the respective quadrupole electrode units 100 and 200. If the potential Vm of the horizontal electrode pieces 17*a* to 19*b* is higher than the potential Vf of the focusing electrode 4, that is, the pre-focusing and post-focusing electrode units 41 and 42 (the potential Vf being equal to or higher than zero), each of the electron beams which have passed through the respective quadrupole electrodes is diverged in the vertical direction, but converged in the horizontal direction. Accordingly, the spot of the respective electron beam cast upon the phosphor screen represents a generally elliptical shape with its long axis lying in the vertical direction as shown by (a) in FIG. 13. On the other hand, if the potential Vm is equal to the potential Vf, no quadrupole lens is formed. Therefore, the spot of the respective electron beam cast upon the phosphor screen represents a circular shape as shown by (b) in FIG. 13. If the potential Vm is lower than the potential Vf, the respective electron beam having passed through the associated quadrupole electrode is diverged in the horizontal direction, but converged in the vertical direction whereby the spot of the electron beam cast upon the phosphor screen represents a generally elliptical shape with its long axis lying in the horizontal direction as shown by (c) in FIG. 13**.

In this way, by varying the modulating voltage Em, that is, the potential Vm of the quadrupole electrode structure, the shape of the electron beam spot on the phosphor screen can be adjusted before the electron beam enters the principal lens. With the utilization of this phenomenon, any possible distortion of the electron beam under the influence of the deflection magnetic field which would result in the distorted spot shape of the electron beam at the peripheral area of the phosphor screen, that is, the deflection aberration, can be substantially corrected or minimized with the consequent improvement in convergence characteristic.

For the modulating voltage Em described hereinabove, a voltage obtained by modulating a deflection current flowing through the deflection yoke can be used.

The result of trial manufacture of the electron gun assembly embodying the present invention has indicated that the ratio of the length of the horizontal axis of the electron beam spot relative to that of the vertical axis could be rendered to be 1.2 or smaller and the maximum value of the difference between the voltages applied to the horizontal electrode pieces and the vertical electrode pieces was 470 volts. Since an optimum voltage to be applied to the focusing electrode 4 is 6,600 volts, the percentage of change in voltage is 7%. Thus, since the percentage of change in voltage is as small as 7%, neither the focusing voltage required in the cathode ray tube nor the convergence characteristic thereof were adversely affected. Although the percentage of change in voltage varies from one cathode ray tube to another, estimation of the maximum value up to 20% is enough. Accordingly, the maximum and minimum values of the voltage required to be applied to the quadrupole electrodes 17 to 19 of the quadrupole electrode structure is 1.2 and 0.8 times the voltage to be applied to the focusing electrode 4, respectively.

It is to be noted that, although in any one of the foregoing embodiments the quadrupole electrode structure has been shown and described as positioned between the pre-focusing and post-focusing electrode unit 41 and 42 forming the focusing electrode 4, it may be positioned at any other location, and even in this case, the performance of the electron gun assembly will not be reduced.

Figure 14A:
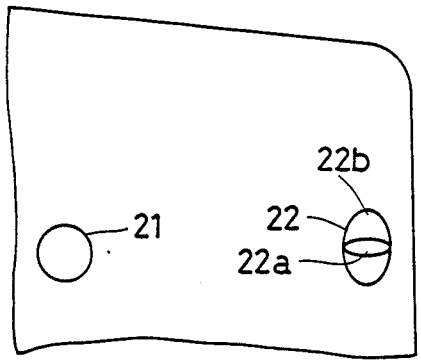
FIG. 14(*a*) to 14(*c*) are schematic diagrams each showing a portion of the phosphor screen of the cathode ray tube, which are used to explain the occurrence of a deflection aberration of the electron beams.
Figure 14B:
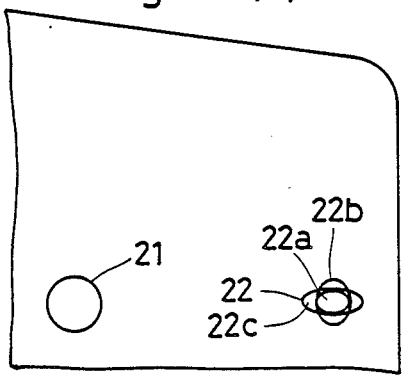
Figure 14C:
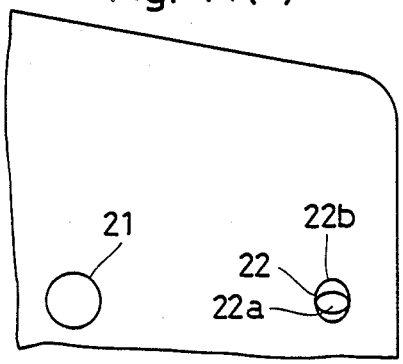

In general, the quadrupole electrode structure acts to reverse the control in the vertical direction and the control in the horizontal direction. In view of this, the prior art cathode ray tube provided with the in-line electron gun assembly makes use of the self-convergence deflection yoke capable of producing the horizontal deflection magnetic field in a generally pincushion pattern and, therefore, no substantial deflection aberration of the electron beam occurs in the horizontal direction. This condition will now be discussed with reference to FIG. 14. In FIG. 14, reference numeral 21 represents the shape of the spot of the electron beam sharply focused on the phosphor screen at a central area thereof, reference numeral 22 represents that of the electron beam deflected in the horizontal direction, and reference numeral 22*a* represents a core, and reference numeral 22*b* represents a halo produced in the vertical direction as a result of the deflection aberration. When in order to minimize the occurrence of the halo 22*b* the modulating voltage Em of parabolic waveform having the potential Vm higher than the potential Vf is applied to the horizontal electrode pieces 17*a* to 19*b* so that the voltage can represent such a waveform that the potential increases progressively by an appropriate value as it approaches the peripheral region, the convergence characteristic in the vertical direction shifts from an over-focused condition towards an under-focused condition with the halo 22*b* consequently reduced in size. On the other hand, the convergence characteristic in the horizontal direction shifts from an in-focus condition towards an over-focused condition and, accordingly, there is a possibility that a halo may occur in the horizontal direction. This condition is shown in FIG. 14(*b*). In other words, FIG. 14(*b*) illustrates the condition in which, although the occurrence of the halo 22*b* in the vertical direction is lessened, a halo 22*c* has occurred in the horizontal direction.

The following fourth preferred embodiment of the present invention is directed to the quadrupole electrode structure used in the cathode ray tube of self-convergence system.

Figure 15:
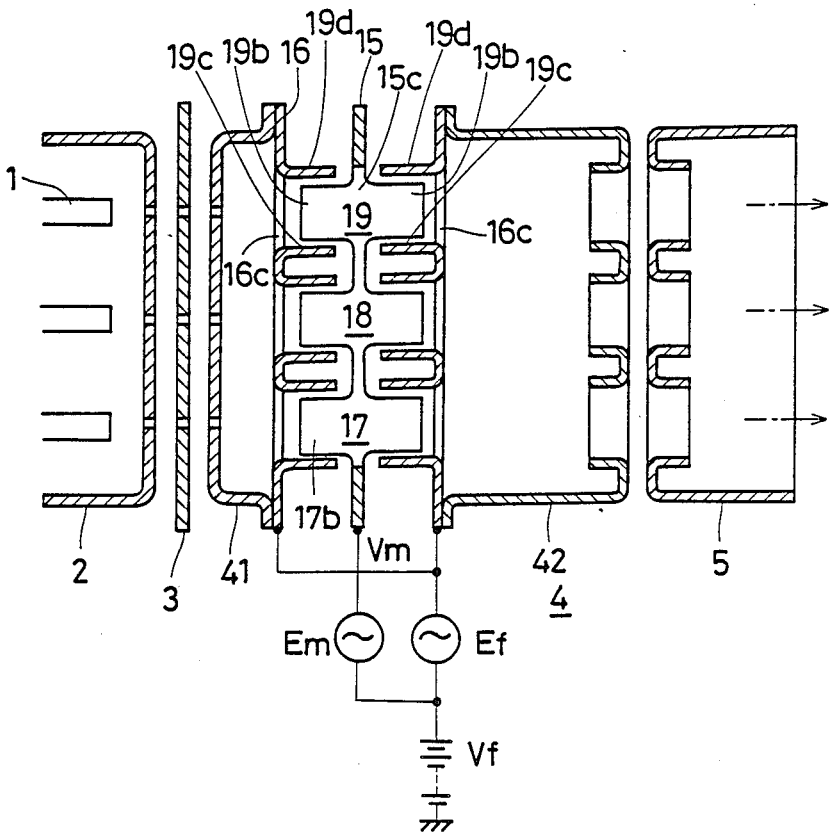
FIG. 15 is a view similar to FIG. 6, showing a fourth preferred embodiment of the present invention.

Referring to FIG. 15, the modulating voltage superimposed on the focusing voltage Vf is indicated by Ef and is cooperable with the modulating voltage Em having a parabolic waveform and adapted to be applied to the quadrupole electrodes 17 to 19 to minimize the occurrence of both of the halo 22*b* in the vertical direction and the halo 22*c* in the horizontal direction. At both side portion of the phosphor screen where the modulating voltage Vf is relatively high, the focusing potential of the focusing electrode 4 is high and the power of the principal lens is weakened, but at a central area of the phosphor screen where the modulating voltage Ef is relatively low the power of the principal lens is high. Since this function acts in both of the vertical and horizontal directions, the occurrence of the halos in the spots of the electron beams over the entire phosphor screen can be minimized if the waveform and the peak value of the modulating voltage Em being applied to the horizontal electrode pieces 17*a* to 19*b* of the quadrupole electrodes 17 to 19 are correspondingly adjusted. FIG. 14(*c*) illustrates the shape of one spot of the electron beam during this condition, and it will readily be seen that, while no halo 22*c* substantially occur in the horizontal direction, the occurrence of the halo 22*b* in the vertical direction is minimized. Accordingly, the resolution of the picture being reproduced on the viewing screen can be improved over the entire surface thereof.

Figure 16:
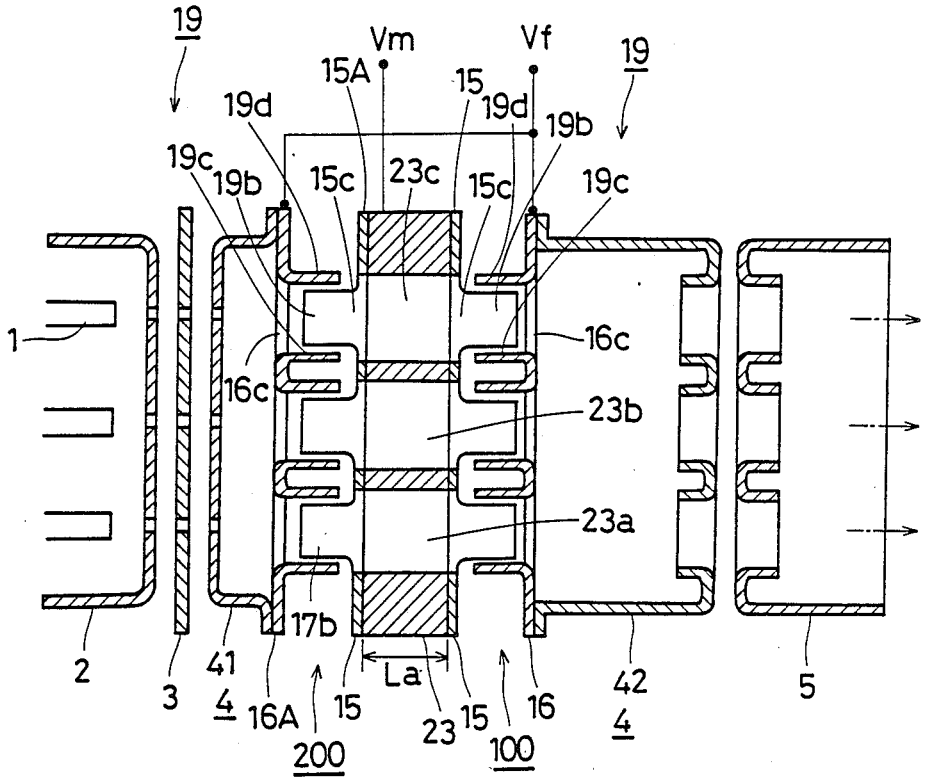
FIG. 16 is a view similar to FIG. 6, showing a fifth preferred embodiment of the present invention.

FIG. 16 illustrates a fifth preferred embodiment of the present invention wherein an electrode piece 23 for forming a unipotential focusing lens (UPF lens) is employed and disposed between the horizontal electrode pieces 17*a* to 19*b* forming the respective quadrupole electrode units 100 and 200, that is, between the base plates 15 and 15A. This UPF lens forming electrode piece 23 has three apertures 23*a*, 23*b* and 23*c* defined therein of an equal length La and of a shape similar to the shape of any one of the apertures 15*a* to 15*c* for the passage of the respective electron beams. With the UPF lens forming electrode piece 23 so positioned between the base plates 15 and 15A, the apertures 23*a* to 23*c* in the UPF lens forming electrode piece 23 are axially aligned with the respective apertures 15*a* to 15*c*. When in use, the modulating voltage Vm which is the focusing voltage Vf superimposed with the modulating voltage Em to be applied to the horizontal electrode pieces 17*a* to 19*b* is applied to this UPF lens forming electrode piece 23.

The UPF lens forming electrode piece 23 acts to form the UPF lens effective not only to lower the performance of the quadrupole lens, but also to exhibit a focusing function in both of the horizontal and vertical directions. The greater the length La, the more prominent this focusing function by the UPF lens. Accordingly, when the UPF lens forming electrode piece 23 having the apertures 23*a* to 23*c* of the equal length La so chosen as to exert the focusing function effective to counteract the diverging action in the horizontal direction is interposed between the quadrupole electrode units 100 and 200, the electron gun assembly having only the focusing function can be obtained.

In view of the foregoing, even during the use of the electron gun assembly according to the fifth embodiment of the present invention each of the electron beams focused on the central area of the phosphor screen is deflected in the horizontal direction as it passes through the deflection magnetic field developed in the pincushion pattern the horizontal direction. When the modulating voltage Vm of appropriate value is applied to the UPF lens forming electrode piece 23, a halo 22*c* in the horizontal direction such as shown in FIG. 15(*b*) will not occur and such a spot as shown in FIG. 14(*c*) will be formed on the phosphor screen.

As hereinbefore described, the electron gun assembly according to the fifth embodiment of the present invention has no substantial function to control the spot shape in the horizontal direction, but to control it in the vertical direction, and, therefore, adjustment of the spot shape of the electron beam at the peripheral area of the phosphor screen can readily be accomplished with the consequent improvement in resolution over the entire surface of the phosphor screen.

Figure 17:
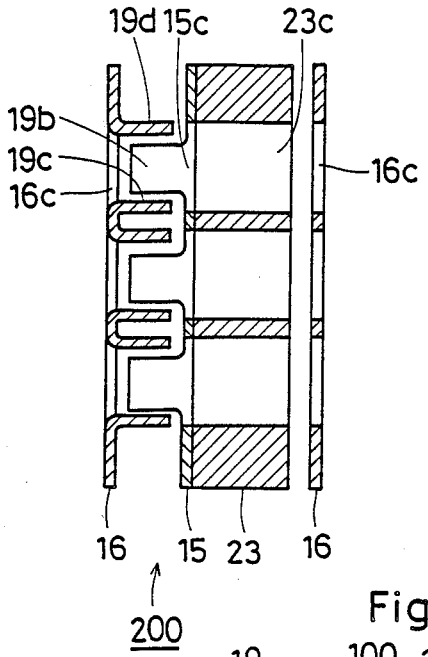
FIGS. 17 and 18 are schematic side sectional views showing modified forms of the quadrupole electrode structure shown in FIG. 16, respectively.
Figure 18:
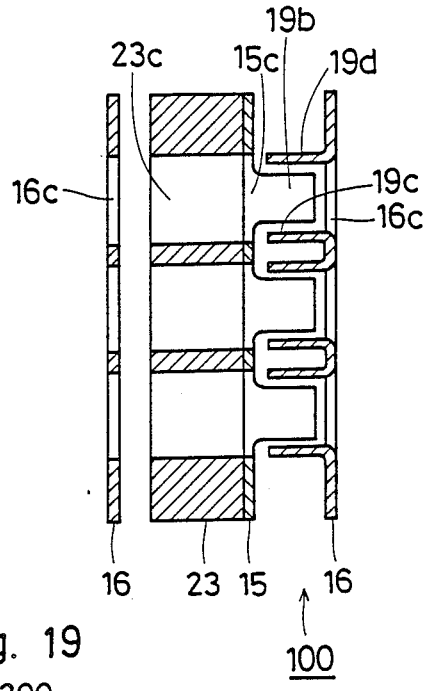

Although in describing the fifth preferred embodiment of the present invention the UPF lens forming electrode piece 23 has been shown and described as positioned between the quadrupole electrode units 100 and 200, the number of the quadrupole electrode units may not be always limited to two such as shown and described, but may be one. For example, as shown in FIGS. 17 and 18, the UPF lens forming electrode piece 23 may be positioned on either side of the single quadrupole electrode unit remote from or adjacent to the cathodes, respectively.

Figure 19:
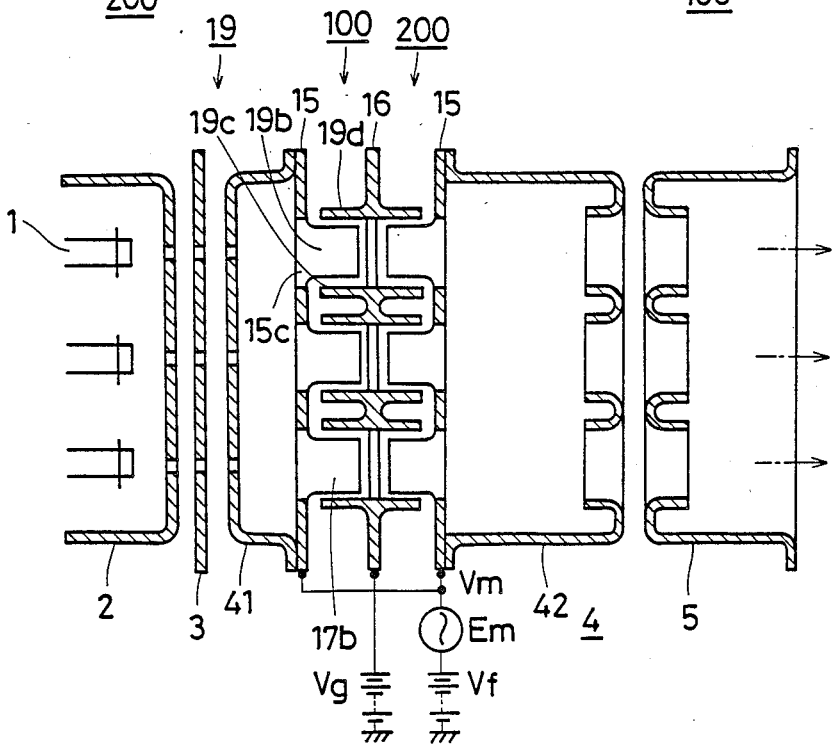
FIG. 19 is a schematic horizontal sectional view of the quadrupole electrode structure according to a sixth preferred embodiment of the present invention.

A sixth preferred embodiment of the present invention is shown in FIG. 19. The quadrupole electrode structure according to this sixth embodiment of the present invention is similar to that according to the third embodiment of the present invention shown in and described with reference to FIGS. 11 and 12, however, the horizontal electrode pieces and the vertical electrode pieces in the quadrupole electrode structure of the sixth embodiment are reversed in position relative to each other as compared with that of the third embodiment. In other words, in the sixth embodiment of the present invention shown in FIG. 19, the quadrupole electrode structure is a version wherein, instead of the first base plates 15 and 15A being joined together in back-to-back fashion such as shown in FIGS. 11 and 12, the second base plates 16 and 16' are joined together in back-to-back fashion with the first base plates 15 and 15A positioned in respective sides of the joined first base plates 15 and 15A.

When in use, a predetermined voltage Vg is first applied to the vertical electrode pieces 17*c* to 19*d*. The modulating voltage Vm obtained by superimposing the modulating voltage Em on the focusing voltage Vf is applied to both of the focusing electrode 4 and the horizontal electrode piece 17*a* to 19*b*. If the voltage Vg is equal to the modulating voltage Vm, no quadrupole lens is formed and, accordingly, the principal lens formed by the focusing electrode 4 acts predominantly to converge the electron beams. However, if the focusing voltage Vf is modulated so as to render the voltage Vg to be lower than the modulating voltage Vm, the quadrupole lens is formed accompanied by the reduction in focusing performance of the principal lens. In such case, with respect to the vertical direction of the electron beams, the electron beams are diverged by the action of the quadrupole lens and also considerably by the principal lens because, as they pass through the principal lens, they receive a convergence less than that exhibited when the voltage Vg is equal to the modulating voltage Vm.

On the other hand, with respect to the horizontal direction of the electron beams, the electron beams are converged by the quadrupole lens and slightly diverged by the principal lens as compared with that exhibited when the voltage Vg is equal to the modulating voltage Vm. Accordingly, the operation of the quadrupole lens and the modulation by the principal lens counteract with each other, with the consequence that the quadrupole lens does exhibit neither the converging action nor the diverging action.

Where the focusing voltage Vf is modulated so as to render the voltage Vg to be higher than the modulating voltage Vm, the quadrupole lens is formed and the converging action of the principal lens is intensified. Accordingly, with respect to the vertical direction, the electron beams are converged by the quadrupole lens and also receive a stronger converging action from the principal lens than that exhibited when the voltage Vg is equal to the modulating voltage Vm. As a result thereof, the electron beams are considerably converged in the vertical direction.

On the other hand, with respect to the horizontal direction, the electron beams are diverged by the quadrupole lens and also receive a stronger converging action from the principal lens than that exhibited when the voltage Vg is equal to the modulating voltage Vm. As a result thereof, the operation of the quadrupole lens and the modulation by the principal lens counteract with each other as is the case where the voltage Vg is lower than the modulation voltage Vm, with the consequence that the quadrupole lens does not exhibit neither the converging action nor the diverging action.

From the foregoing, it has now become clear that, by modulating the focusing voltage Vf, the vertical orientation of the electron beams can be controlled.

Figure 20:
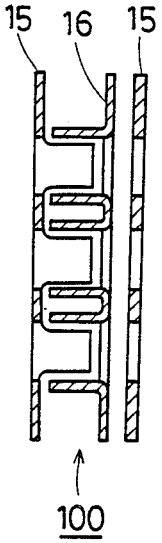
FIG. 20 is a schematic horizontal sectional view of the quadrupole electrode structure according to a seventh preferred embodiment of the present invention.
Figure 21:
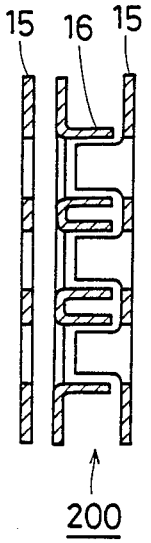
FIG. 21 is a diagram similar to FIG. 20, showing a modified form of the quadrupole electrode structure shown in FIG. 20.

It is to be noted that a similar effect can be obtained even where, although in the foregoing sixth embodiment the quadrupole electrode structure has been shown and described as comprised of the quadrupole electrode units 100 and 200, only one of them is utilized as shown in FIG. 20 or FIG. 21, respectively, though the sensitivity appears to lower to a certain extent.

Hereinafter, a power source circuit for applying the required voltages to the quadrupole electrode structure will be described.

Figure 22:
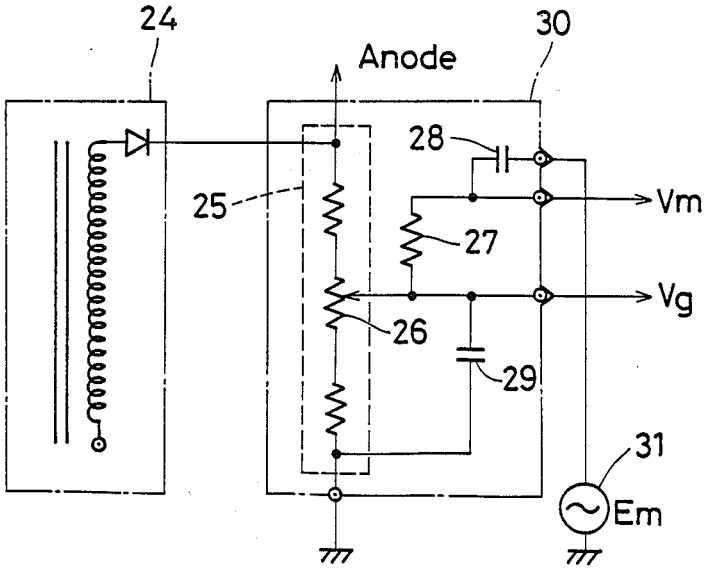
FIG. 22 is a circuit diagram showing a power source circuit useable in connection with the quadrupole electrode structure according to the present invention.

FIG. 22 illustrates one example of a power source circuit which is suited for use with the quadrupole electrode structure shown in and described with reference to FIG. 19. The power source circuit shown therein comprises a high voltage generating circuit 24, a divider 25 for providing a focusing voltage and comprised of a series-circuit including fixed resistors and a variable or focusing resistor 26. The focusing voltage can be obtained in the form of a DC voltage from a movable tap of the focusing resister 26. The circuit also comprises a resistor 27 of relatively high resistance connected between the horizontal electrode pieces and the vertical electrode pieces, a parabolic voltage source 31, and capacitors 28 and 29 for applying a parabolic voltage Em directly to the horizontal electrode pieces and the vertical electrode pieces. The divider 25, the resistor 27, and the capacitors 28 and 29 are fabricated into a block 30 molded of electrically insulating material.

Figure 23:
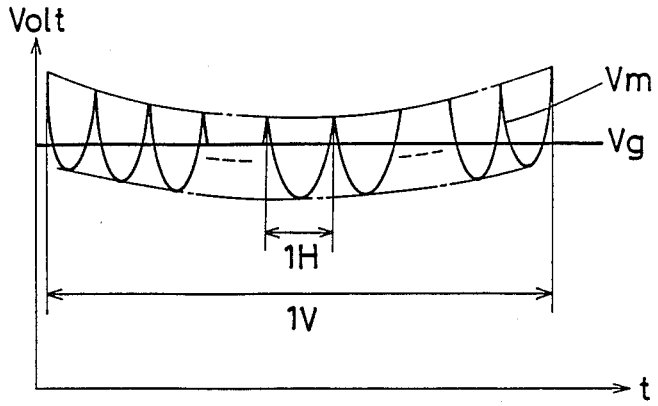
FIGS. 23(*a*) and 23(*b*) are schematic graphs each showing the different characteristic of a voltage applied to the quadrupole electrode structure.
Figure 23B:
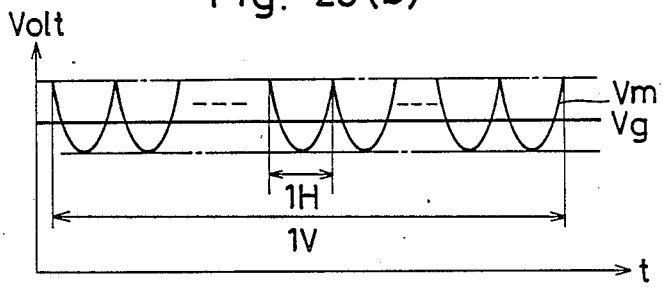

Respective waveforms of the voltages to be applied to the quadrupole electrode structure used in the electron gun assembly depend on the curvature of the phosphor screen, the deflection angle, the aberration characteristic of the deflection yoke and other factors of the color cathode ray tube used. However, in the case of the electron gun assembly utilizing the quadrupole electrode structure shown in FIG. 19, as shown in FIG. 23(*a*), the voltage Vg represents a waveform similar to the direct current, and the voltage Vm represents a waveform of the parabolic voltage synchronized with the horizontal deflection period 1 H and the vertical deflection period 1 V, the average value of which parabolic voltage is equal to the voltage Vg. On the other hand, where the required amount of correction in the Y-axis direction of the phosphor screen is small, as shown in FIG. 23(*b*), it may be of a parabolic waveform synchronized only with the horizontal deflection period 1 H. The power source circuit shown in FIG. 22 is used to apply the voltage Vg of such parabolic waveform to the horizontal electrode pieces and the vertical electrode pieces.

The common DC voltage to be applied to the quadrupole electrode, which is obtained by dividing the anode voltage of the cathode ray tube generated from the high voltage generating circuit 24 is applied to one of the horizontal and vertical electrode pieces directly through the focusing resistor 26 and also to the other of the horizontal and vertical electrode pieces through the resistor 27 of a few megaohms to a few decades of megaohms. The impedance in a circuit between the power source circuit shown in FIG. 22 and the quadrupole electrode structure is of a substantially infinite value. Accordingly, it is possible to apply the direct current voltage of the same potential even though it flows through the resistor 27. On the other hand, the parabolic voltage Em to be applied between the horizontal electrode pieces and the vertical electrode pieces, which is to synchronized with the deflection period is synthesized from a parabolic voltage source 31 and is then applied directly to the opposite ends of the resistor 27, that is, between the horizontal electrode pieces and the vertical electrode pieces, through the capacitors 28 and 29. By so applying the parabolic voltage through the capacitors 28 and 29, the voltage Em from the parabolic voltage source 31 can be efficiently applied to the horizontal electrode pieces and the vertical electrode pieces.

The focusing voltage of direct current to be applied to the quadrupole electrode structure is usually of a considerably high value generally equal to 20 to 30% of the anode voltage. Because of this, the resistor 27 and the capacitors 28 and 29 are assembled together with the resistor 27 into an IC component which is in turn molded into the block by the use of an electrically insulating material, for the purpose of providing reliable and simple circuit. For the parabolic voltage source 31, the conventional dynamic focusing circuit may be employed, and may be formed into a transformer or may be comprised of a resonance circuit having a resonance characteristic similar to a sine wave. In any event, these are well known in the art and, therefore, the details are not herein reiterated for the sake of brevity.

In the preceding description, reference has been made to the electron gun assembly of a construction which does not require the difference in direct current potential between the current applied to the horizontal electrode piece and the vertical electrode pieces, respectively. However, where the difference in direct current potential is required in view of some limitations imposed on the structure of the electron gun assembly, the power source circuit may be constructed as shown in and will now be described with reference to FIG. 24.

Figure 24:
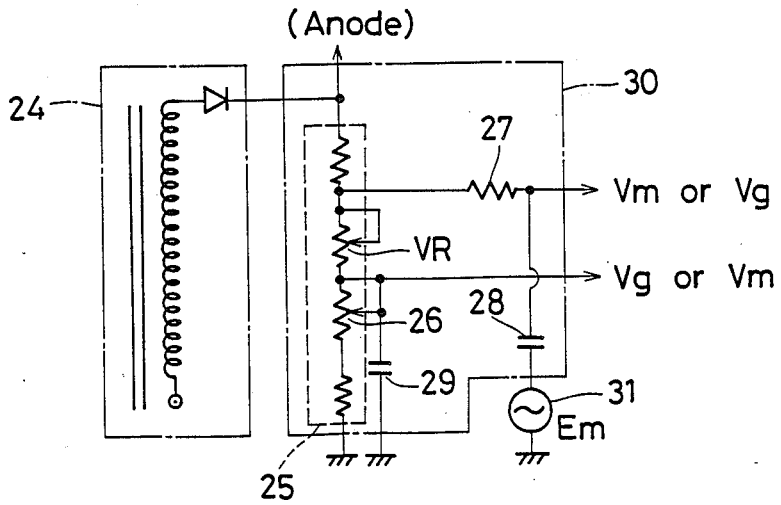
FIG. 24 is a circuit diagram showing a modified form of the power source circuit.

The power source circuit shown in FIG. 24 comprises a variable resistor VR, the position or setting of the movable tap of which determines the DC voltage to be applied between the horizontal electrode pieces and the vertical electrode pieces. Although a fixed resistor may be employed in place of the variable resistor VR, the variable resistor VR when used such as shown has a resistance value lower than the focusing resistor 26. It is to be noted that the direct current voltage between the horizontal electrode pieces and the vertical electrode pieces may be obtained from a clamp circuit using a diode and a capacitor.

Figure 25:
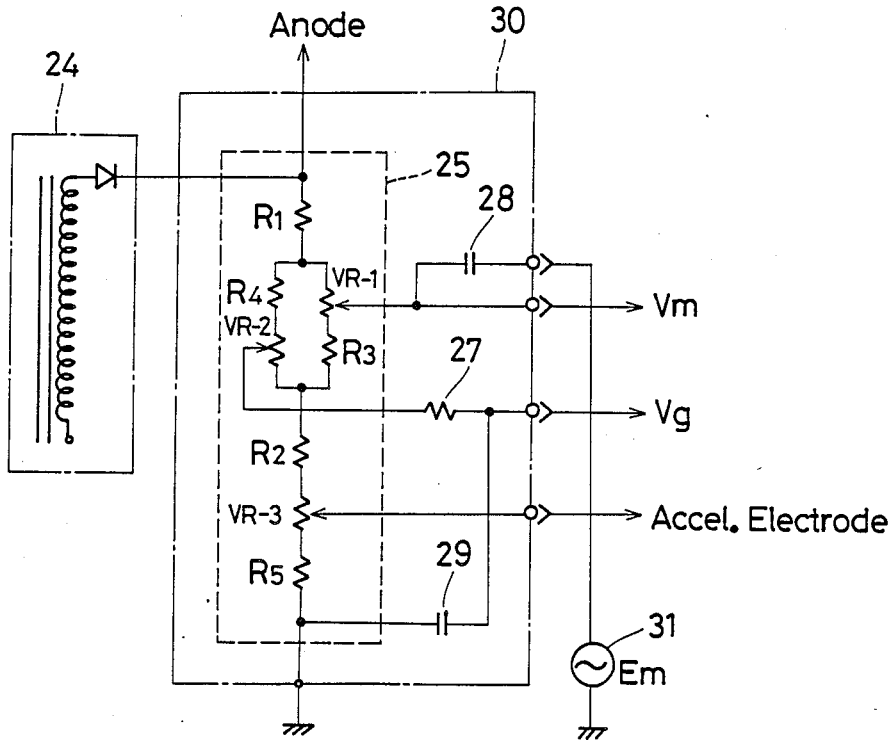
FIG. 25 is a circuit diagram showing a further modified form of the power source circuit.

Another example of the power source circuit is illustrated in FIG. 25. In describing the power source circuit shown in FIG. 25, it will be assumed that the power source circuit of FIG. 25 is used in connection with the quadrupole electrode structure shown in FIG. 19.

The divider 25 used in the power source circuit shown in FIG. 25 comprises a high-voltage side resistor R1, a parallel-connected resistor circuit, and a low-voltage side series-connected resistor circuit including resistor R2, variable resistor VR-3 and resistor R5. The parallel-connected resistor circuit includes series-connected variable and fixed resistors VR-1 and R3 and series-connected fixed and variable resistors V4 and VR-2. The variable resistors VR-1 for the adjustment of the voltage Vm being connected in opposite sense to the variable resistor VR-2 for the adjustment of the voltage Vg. Specifically, where the voltage Vm is desired to be higher by about 500 volts than the voltage Vg, the fixed resistors R3 and R4 are connected to the cold side of the variable resistor VR-1 and the hot side of the variable resistor VR-2, respectively.

The variable resistor VR-1 has a movable tap connected direct to the horizontal electrode pieces and also to the parabolic voltage source 31 through the capacitor 28. On the other hand, the variable resistor VR-2 has a movable tap connected to the vertical electrode pieces through the resistor 27 of relatively high resistance. Although not shown, a resistor of a resistance low compared with the resistor 27 is connected between the horizontal electrode pieces and the variable resistor VR-1. The capacitor 29 has one end connected to a junction between the resistor 27 and a Vg output terminal through which the resistor 27 is connected to the vertical electrode pieces. The other end of the capacitor 29 is grounded through a cold side of the series-connected resistor circuit. A cold side of the parallel-connected resistor circuit is connected with the series-connected resistor circuit including the resistors R2, VR-3 and R5, said variable resistor VR-3 having a movable tap connected with the accelerating electrode 3.

With the power source circuit so constructed as hereinabove described with reference to FIG. 25, the direct current voltages to be applied respectively to the horizontal electrode pieces and the vertical electrode pieces can be adjusted to respective optimum values by adjusting the resistance settings of the associated variable resistors VR-1 and VR-2 independently. Also, the alternating current voltage to be applied to the horizontal electrode pieces can be effectively applied through the capacitors 28 and 29 to the parallel-connected resistor circuit and the opposite ends of the resistor 27, that is, between the horizontal electrode pieces and the vertical electrode pieces. Because of the employment of the capacitor 29, no alternating current component is substantially applied to the vertical electrode pieces. Where the alternating current voltage contains a vertical component (50 to 70 Hz), the selection of the resistor 27 having a resistance of about a few decades of megaohms is efffective to compensate for the shortcoming in capacitance of the capacitors 28 and 29. With this circuit arrangement, since the series-connected resistances of the entire resistor network does not change substantially, the voltage to be applied to the accelerating electrode can be extracted without interference accompanied. The reason that the resistor 27 is connected to the vertical electrode pieces and not to the horizontal electrode pieces is that a leak in current from the focusing electrode tends to occur across the anode electrode and the possibility of leakage from the anode electrode towards the horizontal electrode piece is high. In other words, the leak of current from the vertical electrode pieces which are not in face-to-face relationship with the anode electrode does not occur so often, or seldom occurs. Therefore, the resistor 27 is connected to the vertical electrode pieces. In view of this, it is possible to minimize any change in direct current voltage between the horizontal electrode pieces and the vertical electrode pieces which would result from the leak of current.

Since the voltage flowing in the resistor and capacitor network of the voltage source circuit, that is, the circuit portion of the voltage source circuit excluding the high voltage generator 24, is very high, i.e., substantially equal to about 20 to 35% of the anode voltage, the resistor and capacitor network of the voltage source circuit is assembled into a single block 30 molded with an electrically insulating material as is the case with the power source circuit shown in and described with reference to FIG. 24 for the purpose of improving reliability and ease of handling and providing a substantially improved safety factor and also for the purpose of enabling the circuit as a whole to be simple. Alternatively, the resistor and capacitor network can be integrated together with a high voltage generating circuit such as, for example, a flyback transformer. Although in the illustrated circuit the parallel-connected resistor circuit has been described and shown as having the variable resistors VR-1 and VR-2 connected in series with the resistors R3 and R4, respectively, they may also be omitted.

Moreover, in the power source circuit shown in FIG. 25, a hot side of the resistor R1 has been connected with the high voltage output of a flyback transformer, i.e., the high voltage generator 24, however, it may be connected with an intermediate terminal of the winding of the flyback transformer. If desired, the resistor R1 on the high voltage side can be dispensed with.

Figure 26:
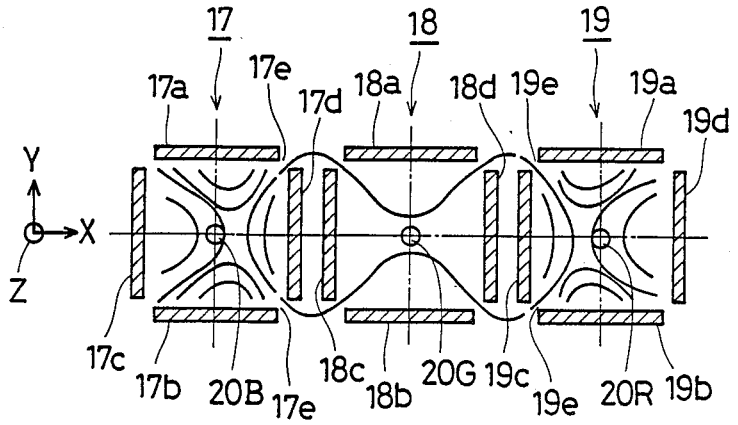
FIG. 26 is a schematic cross-sectional representation of the quadrupole electrode structure having three quadrupole electrodes, used for the purpose of discussion of a problem inherent in the quadrupole electrode structure.

As hereinbefore described, and as shown in FIG. 26, the quadrupole electrode structure for the three-beam electron gun assembly comprises, for each quadrupole electrode, a pair of horizontal electrode pieces 17*a* and 17*b*, 18*a* and 18*b*, or 19*a* and 19*b*, spaced a predetermined distance from each other in the vertical direction, and a pair of vertical electrode pieces 17*c* and 17*d*, 18*c* and 18*d*, or 19*c* and 19*d*, spaced a predetermined distance from each other in the horizontal direction. The pair of horizontal electrode pieces and said pair of vertical electrode pieces are positioned and arranged to define a respective open-ended duct for the passage of the associated electron beam 20B, 20G or 20R while held in symmetrical relationship with each other with respect to the longitudinal axis of the duct.

In this quadrupole electrode structure, if for the potential of the vertical electrode pieces 17*c* to 19*d* for each quadrupole electrode 17 to 19 is set to be lower than that of the horizontal electrode pieces 17*a* to 19*b*, an electric force acts on the respective electron beam 20 so as to pull the electron beam 20 up and down, i.e., outwardly in the vertical direction and the cross-sectional representation of the respective electron beam 20 which has been circular is deformed to an elliptical shape with its long axis lying in the vertical direction.

Conversely, if for each quadrupole electrode 17 to 19 the potential of the horizontal electrode pieces 17*a* to 19*b* is set to be lower than the vertical electrode pieces 17*c* to 19*d*, the respective electron beam is deformed so as to represents the elliptical cross-sectional shape with its long axis lying in the horizontal direction. If both are set to be equal to each other, no electron beam is deformed in its cross-sectional shape.

Accordingly, if the voltage having a voltage waveform effective to correct the deflection aberration which each of the electron beams 20 may eventually bring about under the influence of the deflection magnetic field, which voltage is synchronized with such deflection magnetic field, is applied to the vertical electrode pieces 17*c* to 19*d* and the horizontal electrode pieces 17*a* to 19*b*, the deflection aberration can be substantially effectively eliminated and substantially circular spot of the electron beams 20 can be cast on the entire phosphor screen of the cathode ray tube.

Figure 27:
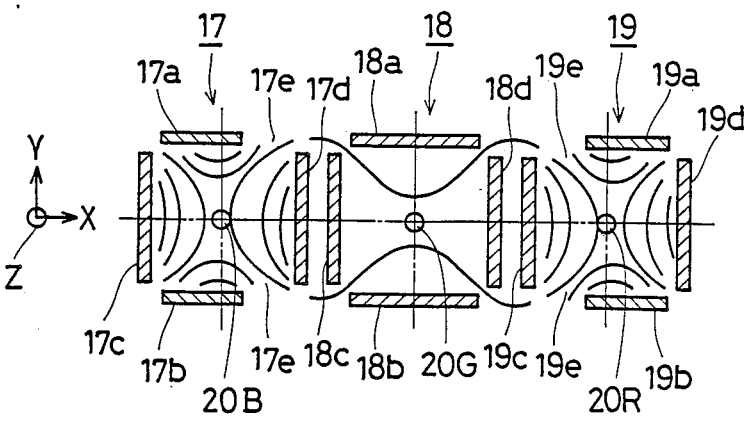
FIGS. 27, 28, and 29 are schematic views similar to FIG. 26, showing the quadrupole electrode structure according to eighth, ninth and tenth preferred embodiments of the present invention, respectively.

With this quadrupole electrode structure, it has been found that the electron beams 20B and 20R traveling through the respective ducts in the quadrupole electrodes 17 and 19 tends to be adversely affected by a charge, developed by the quadrupole electrode 18 positioned intermediate between the quadrupole electrodes 17 and 19, through respective pairs of gaps 17*e* and 19*e* defined between one of the vertical electrode pieces 17*d* and the horizontal electrode pieces 17*a* and 17*b* of the quadrupole electrode 17 and between one of the vertical electrode pieces 19*c* and the horizontal electrode pieces 19*a* and 19*b* of the quadrupole electrode 19 as indicated in FIG. 26. Once this happens, the electric field adjacent the longitudinal axis of each of the respective ducts in the quadrupole electrodes 17 and 19 through which the associated electron beams 20B and 20R travel becomes asymmetrical with respect to the vertical plane passing through the longitudinal axis of the respective duct as shown in FIG. 27, resulting in a misconvergence of the respective electron beam 20B or 20R. If the voltage to be applied to the quadrupole electrode structure is changed, this misconvergence of the respective electron beam 20B or 20R tends to be enhanced.

The foregoing problem can be substantially eliminated according to the alternative arrangements which will now be described with reference to FIGS. 27, 28, 30 and 31, respectively.

Referring first to FIG. 27, the horizontal electrode pieces 17*a* and 17*b*, or 19*a* and 19*b*, of each of the quadrupole electrodes 17 and 19 which are positioned on respective side of the intermediate quadrupole electrode 18 have a width smaller than the horizontal electrode pieces 18*a* and 18*b* so that the paired gaps 17*e* or 19*e* can be enlarged. In this arrangement, the electric field formed by the vertical electrode pieces 17*c* and 19*d* adjacent the intermediate quadrupole electrode 18 can be intensified with the consequence that the pattern of distribution of the electric fields adjacent the respective longitudinal axes of the ducts in the quadrupole electrodes 17 and 19 through which the associated electron beams 20B and 20R travel can be rendered to be substantially symmetrical with respect to the vertical planes passing through such longitudinal axes as shown in FIG. 27. Therefore, even if the voltage for the correction of the deflection aberration is applied to the quadrupole electrode structure, no change occurs substantially in convergence.

It is to be noted that, instead of the employment of the width-reduced vertical electrode pieces 17*a* and 17*b* or 19*a* and 19*b* of each quadrupole electrode 17 or 19, a similar effect can be accomplished even when the positions of the vertical electrode pieces 17*a* and 19*b* or 19*a* and 19*b* of each quadrupole electrode 17 or 19 are displaced laterally in a direction away from the intermediate quadrupole electrode 18 to reduce the effective width thereof.

Figure 28:
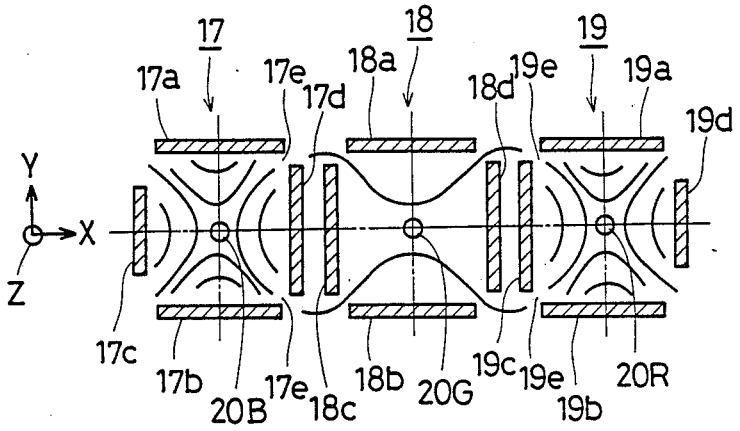

In the arrangement shown in FIG. 28, one of the vertical electrode pieces 17*c* or 19*d* of each of the quadrupole electrodes 17 and 19, which is remotest from the intermediate quadrupole electrode 18 is reduced in width and is so positioned perpendicular to the X-axis passing intermediately of the width thereof.

According to the arrangement shown in FIG. 28, the electric fields adjacent the respective longitudinal axes through which the electron beams 20B and 20R travel can be intensified with the consquence that the pattern of distribution of the electric fields adjacent the respective longitudinal axes of the ducts in the quadrupole electrodes 17 and 19 can be rendered to be substantially symmetrical with respect to the vertical planes passing through such longitudinal axes as shown in FIG. 28. Therefore, even the arrangement shown in FIG. 28 can bring about an effect similar to that exhibited by the arrangement shown in and described with reference to FIG. 27.

It is to be noted that, although each of the electrode pieces of all of the quadrupole electrodes has been shown and described as employed in the form of a plate-like configuration, it may be arcuate, elliptical, or inwardly or outwardly curved with respect to the longitudinal axis through which the associated electron beam travels.

Figure 29:
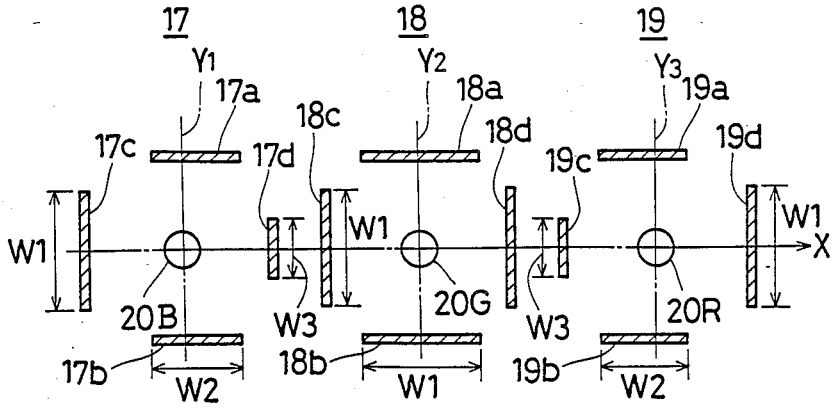

In the arrangement shown in FIG. 29, one of the vertical electrode pieces 17*c* of the quadrupole electrode 17 which is remotest from the intermediate quadrupole electrode 18, all of the horizontal and vertical electrode pieces 18*a* to 18*d* of the intermediate quadrupole electrode 18, and one of the vertical electrode pieces 19*d* of the quadrupole electrode 19 which is remotest from the intermediate quadrupole electrode 18 have an equal width as indicated by W1. The horizontal electrode pieces 17*a* and 17*b* of the quadrupole electrode 17 and the horizontal electrode pieces 19*a* and 19*b* of the quadrupole electrode 19 have an equal width as indicated by W2. The other of the electrode pieces 17*d* of the quadrupole electrode 17 and the other of the electrode pieces 19*c* of the quadrupole electrode 19, both situated close to the intermediate quadrupole electrode 18, have an equal width as indicated by W3. The width W1 is selected to be greater than the width W2 which is in turn selected to be equal to or greater than the width W3. While the horizontal and vertical electrode pieces 18*a* and 18*b* of the intermediate quadrupole electrode 18 are so positioned and so arranged as to assume a symmetrical relationship with respect to the X-axis and the Y2-axis perpendicular to the X-axis and passing through the longitudinal axis of the duct in the intermediate quadrupole electrode 18. The vertical electrode pieces 17*c* and 17*d* or 19*c* and 19*d* of each of the quadrupole electrodes 17 and 19 are so positioned and so arranged as to assume a symmetrical relationship with respect to the X-axis and the Y1-axis or Y3-axis and the horizontal electrode pieces 17*a* and 17*b* or 19*a* and 19*b* of each of the quadrupole electrodes 17 and 19 are so positioned and so arranged as to assume a symmetrical relationship with respect to the X-axis, but displaced inwardly with respect to the associated Y1-axis or Y3-axis in a direction parallel to the X-axis.

The operation of the electron gun assembly of the construction shown in FIG. 19, but employing the quadrupole electrode structure shown in and described with reference to FIG. 29 will now be described. It is to be noted that, for the purpose of discussion of the operation of the electron gun assembly referred to above, the voltages Vg and Vf shown in FIG. 19 are assumed to be equal to each other.

Since the quadrupole electrodes 17 and 19 on respective side of the intermediate quadrupole electrode 18 are so structured as to be asymmetrical with respect to the X and Y axes, the quadrupole lens formed in each of the quadrupole electrodes 17 and 19 when the modulating voltage Em is applied thereto assumes an asymmetrical shape. Where the modulating voltage Em applied is high, as shown in an upper portion under column (b) in FIG. 30, forces acting in respective directions shown by the solid-line arrows act on a core portion 22*a* (hatched region) of the respective electron beam spot at the peripheral area of the phosphor screen while forces acting in respective directions shown by the broken-line arrows which are counter to the direction shown by the solid-line arrow act on a halo portion 22*b*. Therefore, the effect is that the elliptical shape with its long axis lying in the vertical direction can be corrected to a small circle as shown in an upper portion under column (a) in FIG. 30 and, at the same time, forces acting in the directions shown by the arrows act on each of the electron beams 20R and 20B as shown in a lower portion under column (b) in FIG. 30 to produce a convergence drift as shown.

However, if the modulating voltage Em is high, the voltage Vm, that is, the sum of the voltages Vf and Em, is correspondingly high. In such case, as shown in an upper portion under column (c) in FIG. 30, by the focusing action of the principal lens the respective electron beams can be converged to represent a smaller circular shape. Therefore, as shown in an upper portion under column (d) in FIG. 30, in combination with the function of the quadrupole electrode structure, the respective electron beam can form a smaller circular spot 21 on the phosphor screen when the electron beam impinges upon the phosphor screen.

Figures 30, 31:
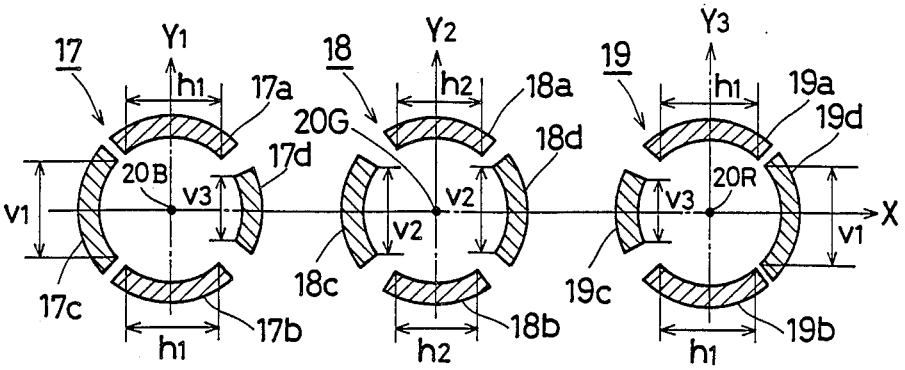
FIG. 30 is a chart showing the operating characteristic of the quadrupole electrode structure shown according to the tenth preferred embodiment of the present invention shown in FIG. 29.
FIG. 31 is a schematic view similar to FIG. 26, showing the quadrupole electrode structure according to an eleventh preferred embodiment of the present invention.

On the other hand, the convergence of the principal lens reduces, accompanied by a drift of each of the electron beams 20B and 20R in a respective direction as shown by the arrow in a lower portion under column (c) in FIG. 30. However, the direction in which the electron beams 20B and 20R are diverged away from each other is counter to the direction of drift accomplished by the quadrupole electrodes 17 and 19 and is therefore counteracted thereby, with the consequence that, as shown in a lower portion under column (d) in FIG. 30, no misconvergence substantially occurs. Accordingly, when the electron gun assembly utilizing the quadrupole electrode structure shown in FIG. 29 is employed in the cathode ray tube, even the use of the dynamic focusing system is employed wherein the modulating voltage Em is superimposed on the focusing voltage Vf results in the small circular shape of the electron beams at the peripheral portion of the phosphor screen and the minimization of the occurrence of misconvergence, and, therefore, the color cathode ray tube of high resolution can be manufactured.

While in the foregoing embodiment the modulating voltage Em is applied to cause the horizontal electrode pieces to exhibit a positive polarity, it may be possible to superimpose the modulating voltage Em on the focusing voltage Vf so that the horizontal electrode piece will become negative relative to the vertical electrode pieces. In such case, the focusing action of the principal lens will be increased, but the quadrupole lens formed in each of the quadrupole electrodes will exhibit a diverging action enough to counteract with the increase in the diverging action of the principal lens and, therefore, no misconvergence substantially occurs.

Also, in the foregoing embodiment, the quadrupole electrode structure has been shown and described as positioned between the prefocusing electrode unit 41 and the post-focusing electrode unit 42 of the focusing electrode 4, but the position thereof may not be always limited thereto. Furthermore, each of the electrode pieces of each quadrupole electrode may have any desired shape, arcuate, parabolic or inwardly or outwardly curved, instead of the plate-like flat configuration such as shown.

In the arrangement shown in FIG. 31, each of all of the horizontal and vertical electrode pieces of all of the quadrupole electrodes 17 to 19 has a generally arcuate cross-sectional shape. The electrode pieces 17*c* and 19*d*, the electrode pieces 17*d* and 19*c*, the electrode pieces 18*c* and 18*d*, the electrode pieces 17*a* and 19*a*, and the electrode pieces 17*b* and 19*b* are so positioned and so arranged as to by symmetrical with each other with respect to the X-axis and the Y2-axis perpendicular to the X-axis and passing through the longitudinal axis of the duct in the quadrupole electrode 18, whereas the electrode pieces 17*a* and 17*b*, the electrode pieces 18*a* and 18*b* or the electrode pieces 19*a* and 19*b* of each quadrupole electrode 17, 18 or 19 are symmetrical with each other with respect to the X-axis. However, one of the vertical electrode pieces 17*c* of the quadrupole electrode 17 which is remotest from the intermediate quadrupole electrode 18 and one of the vertical electrode pieces 19*d* of the quadrupole electrode 19 which is remotest from the intermediate quadrupole electrode 18 have an equal width as indicated by V1. The vertical electrode pieces 18*c* and 18*d* of the intermediate quadrupole electrode 18 have an equal width as indicated by V2. The other of the electrode pieces 17*d* of the quadrupole electrode 17 and the other of the electrode pieces 19*c* of the quadrupole electrode 19, both situated close to the intermediate quadrupole electrode 18, have an equal width as indicated by V3. The width v1 is selected to be greater than the width V2 which is in turn selected to be greater than the width V3. Also, the horizontal electrode pieces 17*a* and 17*b* or 19*a* and 19*b* of each of the quadrupole electrodes 17 and 19 have an equal width as indicated by h1, and the horizontal electrode pieces 18*a* and 18*b* of the intermediate quadrupole electrode 18 have an equal width as indicated by h2, the width h1 being so selected to be greater than the width h2.

Thus, while all four electrode pieces forming the intermediate quadrupole electrode 18 are so positioned and so arranged as to be symmetrical with respect to both of the X-axis and the Y2-axis, each of the quadrupole electrodes 17 and 19 has the horizontal electrode pieces so positioned and so arranged as to be symmetrical with respect to the X-axis, but has the vertical electrode pieces so positioned and so arranged as to be asymmetrical with respect to the associated Y1-axis or Y3-axis. It is to be noted that, in this embodiment of FIG. 31, the widths V1, V2, V3, h1 and h2 are so selected to take different values.

Thus, when each of the quadrupole electrode electrodes 17 and 19 on respective sides of the intermediate quadrupole electrode 18 is made to have an electrode arrangement different from that of the intermediate quadrupole electrode 18, the effect brought about by the quadrupole electrode 18 on the electron beam 20G traveling therethrough can be differentiated from that of the electron beam 20B or 20R traveling through the quadrupole electrode 17 or 19. Specifically, the trajectories of the electron beams 20B and 20R passing through the quadrupole electrodes 17 and 19 are considerably affected in the X-axis direction. Taking advantage of this, the convergence drift which would occur when the quadrupole electrode structure wherein all of the quadrupole electrodes are arranged so as to be symmetrical with respect to the X-axis and also the Y-axis, that is, the displacement of the electron beams 20B and 20R in the X-axis direction, can be minimized to substantially eliminate the drift.

It is to be noted that, although in the description of the embodiment shown in FIG. 31 it has been described that the electrode pieces of the quadrupole electrode 18 have respective widths different from those of the corresponding electrode pieces of each of the quadrupole electrodes 17 and 19, they may not be always limited thereto, but any arrangement of electrode pieces may be employed if they can produce an electric field effective to minimize the convergence drift which would occur when the modulating voltage is applied.

It is to be noted that, although each of the electrode pieces of all of the quadrupole electrodes has been shown and described as employed in the form of a plate-like configuration, it may be arcuate, elliptical, or inwardly or outwardly curved with respect to the longitudinal axis through which the associated electron beam travels. It is also to be noted that the electrode pieces of each quadrupole electrode may be comprised of a combination of flat plate electrode pieces and electrode pieces different in shape from the flat plate electrode pieces, for example, arcuate electrode pieces.

In the following embodiments of the present invention which will subsequently be described with reference to FIGS. 32 and 33 and FIGS. 34 and 35, unique design has been made to the shape of the apertures used in the post-focusing electrode unit 42 and the anode electrode 5. It should be noted however, to be noted that the quadrupole electrode structure may remain the same as that shown in any one of FIGS. 5 and 6 and FIGS. 7 and 8.

Figure 32:
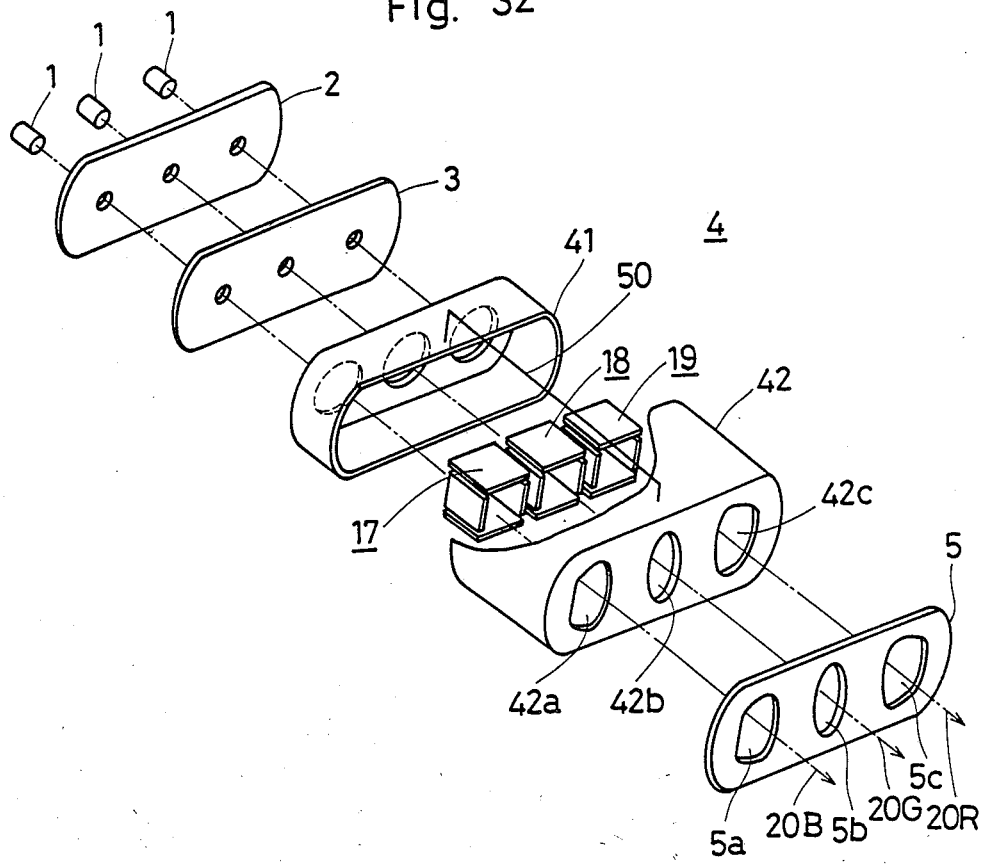
FIG. 32 is a schematic perspective view of the electron gun assembly according to a twelfth preferred embodiment of the present invention.
Figure 33:
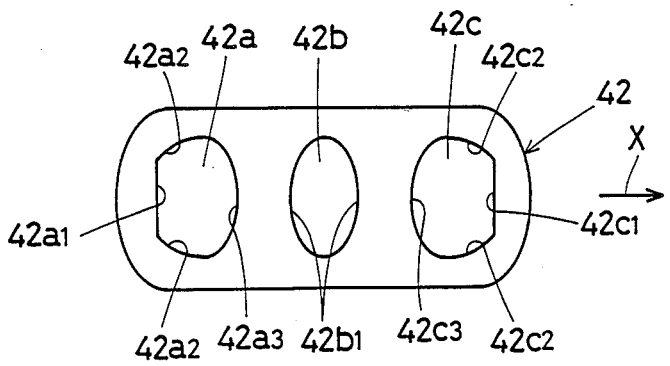
FIG. 33 is a front elevational view, on an enlarged scale, of the focusing electrode used in the electron gun assembly shown in FIG. 32.

More specifically, and referring to FIGS. 32 and 33, the electron gun assembly shown therein is substantially identical with that shown in and described with reference to FIGS. 7 and 8. As hereinbefore described, the post-focusing electrode unit 42 electrically connected with the prefocusing electrode by means of a wiring 50 has the apertures 42*a* to 42*c* defined therein in alignment with the beam guide ducts in the respective quadrupole electrodes 17 to 19. Similarly, the anode electrode 5 has the apertures 5*a* to 5*c* defined therein in alignment with the apertures 42*a* to 42*c*, respectively. As best shown in FIG. 33, the aperture 42*b* for the passage of the electron beam 20G therethrough is of a generally elliptical shape with its long axis lying perpendicular to the X-axis along which the quadrupole electrodes 17 to 19 are arranged in-line fashion, said elliptical aperture 42*b* having a pair of opposite parabolic edges 42*b*1 facing towards each other.

On the other hand, each of the apertures 42*a* and 42*b* for the passage of the electron beams 20B and 20R therethrough, respectively, is delimited by a straight edge 42*a*1 or 42*c*1 positioned at a location remotest from the aperture 42*b* and extending generally perpendicular to the X-axis, a pair of arcuate edges 42*a*2 or 42*c*2 continued from the opposite ends of the straight edge 42*a*1 or 42*c*1 and facing towards each other, and a generally parabolic edge 42*a*3 or 42*c*3 having its opposite ends continued to the arcuate edges 42*a*2 or 42*c*2 and positioned at a location closest to the aperture 42*b*. It should be noted that radius of curvature of the parabolic edge 42*a*3 or 42*c*3 is greater than that of each of the parabolic edges 42*b*1 forming the aperture 42*b*.

While the apertures 42*a*, 42*b* and 42*c* are so shaped as hereinabove described, each of these apertures 42*a* to 42*c* are symmetrical about the X-axis, and the apertures 42*a* and 42*c* are symmetrical about the axis perpendicular to the X-axis and passing through the aperture 42*b* in alignment with the long axis of the shape of the aperture 42*b*.

The apertures 5*a* to 5*c* defined in the anode electrode 5 are identical with the apertures 42*a* to 42*c* in the post-focusing electrode unit 42, respectively.

In general, all of the apertures in both of the post-focusing electrode unit 42 forming a part of the focusing electrode 4 and the anode electrode 5 are elongated in the direction perpendicular to the X-axis. Accordingly, the effective aperture of each of these apertures in the post-focusing electrode unit 42 and the anode electrode 5 is relatively large enough to minimize the aberration of the associated electron lens. Therefore even if the cross-sectional representation of the associated electron beam is generally elongated in the direction perpendicular to the X-axis, no substantial reduction in focusing performance which would bring about the spherical aberration will occur.

The formation of the apertures 42*a* to 42*c* and the apertures 5*a* to 5*c* of the above described shape can be easily accomplished by the use of either any known press work or any known metal perforating technique using a numerically controlled profiling machine. Where the press work is to be employed, the presence of the straight edges 42*a*1 and 42*c*1 makes it easy to prepare required punches and dies precisely complemental in shape to the respective shapes of the apertures 42*a* to 42*c* or 5*a* to 5*c*.

On the other hand, where the perforating technique using the numerically controlled profiling machine is to be employed, one of the straight edges, for example, the straight edge 42*a*1 of the respective apertures 42*a* may be taken as a starting point from which a cutter starts its movement to cut to form the associated arcuate edge 42*a*2, the parabolic edge 42*a*3 and the arcuate edge 42*a*2, finally returning to the straight edge 42*a*1. Subsequently, a similar procedure is carried out to form the aperture 42*c*, during which the initially chosen starting point is used for driving the cutter of the profiling machine. The formation of the aperture 42*b* can thereafter be carried out with the utilization of the straight edges 42*a*1 and 42*c*1 as respective starting points for the drive of the cutter of the profiling machine.

Inspection of the perforations 42*a* to 42*c* after the manufacture of the post-focusing electrode unit 42 can readily and precisely be performed using the starting points which have been used for the perforating operation during the manufacture thereof.

It is to be noted that the foregoing procedures described in connection with the formation of the apertures 42*a* to 42*c* can be applicable to the formation of the apertures 5*a* to 5*c* in the anode electrode 5.

Figure 34:
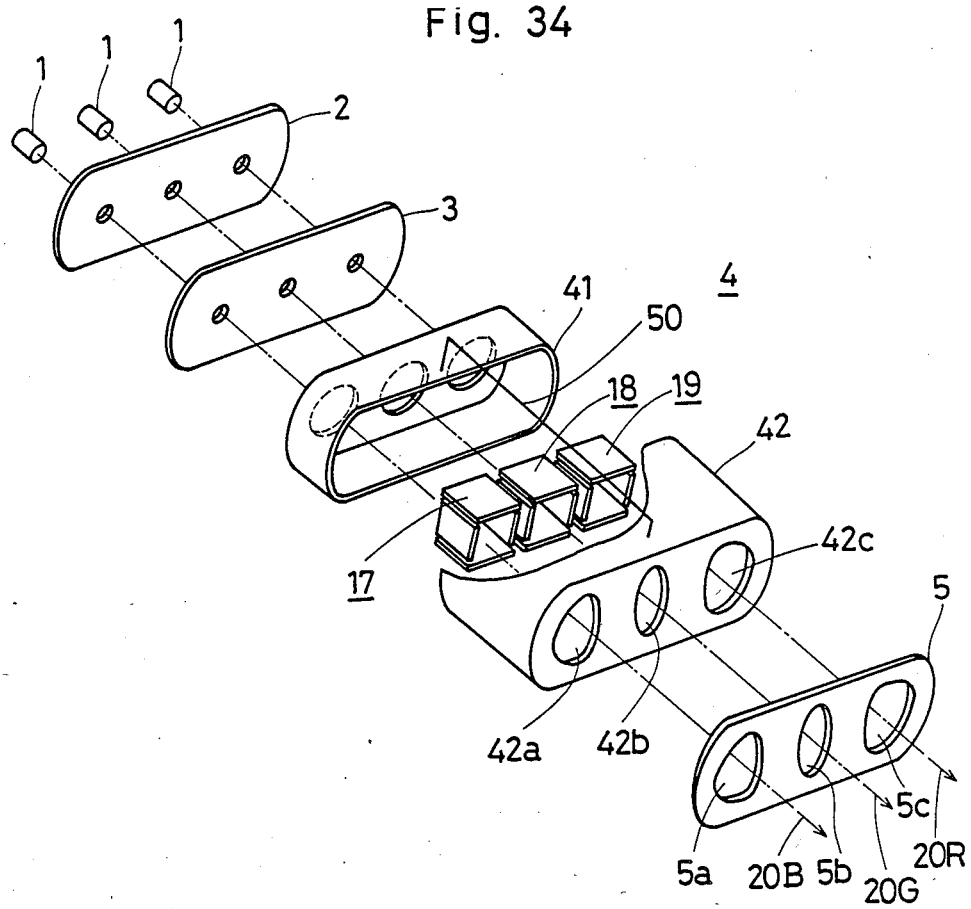
FIG. 34 is a view similar to FIG. 32, showing a thirteenth preferred embodiment of the present invention.
Figure 35:
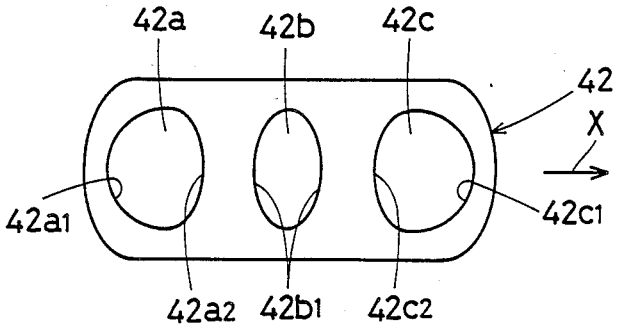
FIG. 35 is a view similar to FIG. 33, showing the focusing electrode used in the electron gun assembly shown in FIG. 34.

In the embodiment shown in FIGS. 34 and 35, the electron gun assembly shown therein is substantially identical with that shown in and described with reference to FIGS. 7 and 8. As hereinbefore described, the post-focusing electrode unit 42 has the apertures 42*a* to 42*c* defined therein in alignment with the beam guide ducts in the respective quadrupole electrodes 17 to 19 and, similarly, the anode electrode 5 has the apertures 5*a* to 5*c* defined therein in alignment with the apertures 42*a* to 42*c*, respectively. As best shown in FIG. 35, the aperture 42*b* for the passage of the electron beam 20G therethrough is of a generally elliptical shape with its long axis lying perpendicular to the X-axis along which the quadrupole electrodes 17 to 19 being arranged in-line fashion, said elliptical apertures 42*b* having a pair of opposite parabolic edges 42*b*1 facing towards each other.

On the other hand, each of the apertures 42*a* and 42*b* for the passage of the electron beams 20B and 20R therethrough, respectively, is delimited by a generally semicircular edge 42*a*1 or 42*c*1 positioned at a location remotest from the apertures 42*b*, and a generally parabolic edge 42*a*2 or 42*c*2 having its opposite ends continued to the semicircular edges 42*a*1 or 42*c*1 and positioned at a location closest to the aperture 42*b*. It should be noted that the the radius of curvature of the parabolic edge 42*a*2 or 42*c*2 is greater than that of each of the parabolic edges 42*b*1 forming the aperture 42*b*.

While the apertures 42*a*, 42*b* and 42*c* are so shaped as hereinabove described, each of these apertures 42*a* to 42*c* are symmetrical about the X-axis, and the apertures 42*a* and 42*c* are symmetrical about the axis perpendicular to the X-axis and passing through the aperture 42*b* in alignment with the long axis of the shape of the aperture 42*b*.

The apertures 5a to 5c defined in the anode electrode 5 are identical with the apertures 42a to 42c in the post-focusing electrode unit 42, respectively.

In general, all of the apertures in both of the post-focusing electrode unit 42 forming a part of the focusing electrode 42 and the anode electrode 5 are elongated in the direction perpendicular to the X-axis. Accordingly, the effective aperture of each of these apertures in the post-focusing electrode unit 42 and the anode electrode 5 is relatively large enough to minimize the aberration of the associated electron lens and, therefore, even if the cross-sectional representation of the associated electron beam is generally elongated in the direction perpendicular to the X-axis, no reduction in focusing performance which would being about the spherical aberration will occur substantially.

Although the present invention has been fully described in connection with the numerous preferred embodiments thereof with reference to the accompanying drawings, it can be varied in numerous ways within the framework of obviousness by those skilled in the art. Such changes and modifications are to be construed as included within the spirit and scope of the present invention as defined by the appended claims, unless they depart therefrom.

What is claimed is:

1. A cathode ray tube apparatus comprising:

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam, each of said horizontal and vertical electrode pieces being in platelike form elongated along the respective electron beams; and power source means for applying a predetermined voltage to the quadrupole electrode structure.

2. The apparatus as claimed in claim 1, wherein the quadrupole electrode structure comprises a first base plate having apertures defined therein being equal in number to the electron beams and a second base plate having apertures defined therein being equal in number to the electron beams, said first base plate having a pair of horizontal pieces spaced from each other and protruding perpendicular to the first base plate from the peripheral lip region of each of the apertures in the first base plate thereby constituting the pair of the horizontal electrode pieces, said second base plate having a pair of vertical pieces spaced from each other and protruding perpendicular to the second base plate from the peripheral lip region of each of the apertures in the second base plate thereby constituting the pair of the vertical electrode pieces.

3. The apparatus as claimed in claim 2, wherein each of the horizontal and vertical electrode pieces of all of the quadrupole electrodes is in the form of a flat plate.

4. The apparatus as claimed in claim 2, wherein the first and second base plates are positioned with their apertures aligned with the perforations in the focusing electrode, respectively, and each of the apertures in all of the first and second base plates being of a square shape having each side equal in length to the diameter of each aperture in the focusing electrode.

5. The apparatus as claimed in claim 2, wherein the angle formed between a first plane passing through one of diagonal pairs of corners delimited by the respective pairs of the horizontal and vertical electrode pieces in each quadrupole electrode and a second plane passing through the other of the diagonal pairs of such corners is selected to be within the range of 85 to 95 degrees, and the line of intersection of these first and second planes being aligned with the trajectory of the respective electron beam.

6. The apparatus as claimed in claim 2, wherein a plurality of the quadrupole electrode structures are employed and arranged one after another in a direction conforming to the direction of travel of the electron beams.

7. The apparatus as claimed in claim 1, wherein the focusing electrode comprises a pre-focusing electrode unit and a post-focusing unit and wherein said quadrupole electrode structure is interposed between the pre-focusing and post-focusing electrode units.

8. The apparatus as claimed in claim 7, wherein the pre-focusing and post-focusing electrode units are electrically connected together.

9. The apparatus as claimed in claim 8, wherein one of the horizontal and vertical electrode pieces of the quadrupole electrodes are electrically connected with one of the pre-focusing and post-focusing electrode units.

10. The apparatus as claimed in claim 1, wherein the power source means comprises a modulating voltage source for generating a modulating voltage synchronized with a deflection period of the electron beams.

11. The apparatus as claimed in claim 10, wherein the modulating voltage generated from the modulating voltage source is a voltage having a parabolic waveform required to correct a deflection aberration of the electron beams.

12. The apparatus as claimed in claim 11, wherein the modulating voltage from the modulating voltage source is applied between the horizontal electrode pieces and the vertical electrode pieces of the quadrupole electrode structure.

13. The apparatus as claimed in claim 12, wherein one of the horizontal electrode pieces and the vertical electrode pieces of the quadrupole electrode structure is electrically connected with the focusing electrode and the other of the horizontal electrode pieces and the vertical electrode pieces of the quadrupole electrode structure is electrically connected with the modulation voltage source.

14. The apparatus as claimed in claim 13, wherein the modulating voltage is superimposed with a direct current voltage to be applied to the focusing electrode.

15. The apparatus as claimed in claim 14, wherein the modulating voltage is of a value within the range of 0.8 to 1.2 times the direct current voltage.

16. The apparatus as claimed in claim 12, wherein one of the horizontal electrode pieces and the vertical electrode pieces of the quadrupole electrode structure is electrically connected with the focusing electrode and adapted to receive a first modulating voltage from the power source circuit and the other of the horizontal electrode pieces and the vertical electrode pieces of the quadrupole electrode structure is adapted to receive a second modulating voltage from the power source means.

17. The apparatus as claimed in claim 16, wherein the first and second modulating voltages are superimposed with a direct current voltage to be applied to the focusing electrode.

18. The apparatus as claimed in claim 12, wherein the vertical electrode pieces of the quadrupole electrode structure are electrically connected with the focusing electrode and the horizontal electrode pieces of the same quadrupole electrode structure are applied with the modulating voltage, to form a uni-potential focusing lens.

19. The apparatus as claimed in claim 18, wherein the modulating voltage is superimposed with a direct current voltage to be applied to the focusing electrode.

20. The apparatus as claimed in claim 18, wherein electrode pieces for forming the uni-potential focusing lens extend from one end of the horizontal electrode pieces on respective sides of the associated electron beam.

21. The apparatus as claimed in claim 12, wherein the horizontal electrode pieces of the quadrupole electrode structure are electrically connected with the focusing electrode and adapted to receive the modulating voltage, and the vertical electrode pieces of the quadrupole electrode structure are adapted to receive a predetermined direct current voltage.

22. The apparatus as claimed in claim 21, wherein the modulating voltage is superimposed with a direct current voltage to be applied to the focusing electrode.

23. The apparatus as claimed in claim 12, wherein the horizontal electrode pieces and the vertical electrode pieces of the quadrupole electrode structure are electrically connected with each other through a resistor, and wherein one of the horizontal electrode pieces and the vertical electrode pieces of the quadrupole electrode structure is adapted to receive a first direct current voltage and the other of the horizontal electrode pieces and the vertical electrode pieces of the quadrupole electrode structure is adapted to receive a second direct current voltage through said resistor, said modulating voltage being applied between the horizontal electrode pieces and the vertical electrode pieces of the quadrupole electrode structure through a capacitor.

24. The apparatus as claimed in claim 23, wherein the first and second direct current voltages are substantially equal to each other.

25. The apparatus as claimed in claim 23, wherein the first and second direct current voltages have a predetermined difference in voltage therebetween.

26. The apparatus as claimed in claim 23, wherein the resistor, the capacitor and a resistor circuit for setting both of the first and second direct current voltages are molded together into a unitary structure with the use of an electrically insulating material.

27. The apparatus as claimed in claim 1, wherein the second quadrupole electrode positioned intermediately between the first and third quadrupole electrodes has a shape different from that of any one of the first and third quadrupole electrodes.

28. The apparatus as claimed in claim 27, wherein each of the first and third quadrupole electrodes is of an asymmetrical configuration with respect to a vertical plane perpendicular to the first direction and containing the associated electron beam.

29. The apparatus as claimed in claim 28, wherein the horizontal electrode pieces of each of the first and third quadrupole electrodes are displaced laterally outwardly of the trajectory of the associated electrode beam.

30. The apparatus as claimed in claim 29, wherein the horizontal electrode pieces of each of the first and third quadrupole electrodes have a width smaller than that of the horizontal electrode pieces of the second quadrupole electrode.

31. The apparatus as claimed in claim 28, wherein one of the vertical electrode pieces of each of the first and third quadrupole electrodes which is located remotest from the second quadrupole electrode has a width smaller than the other of the vertical electrode pieces of each of the first and third quadrupole electrodes which is located closest to the second quadrupole electrode.

32. The apparatus as claimed in claim 28, wherein the horizontal electrode pieces of each of the first and third quadrupole electrodes are displaced laterally inwardly of the trajectory of the associated electron beam.

33. The apparatus as claimed in claim 32, wherein one of the vertical electrode pieces of each of the first and third quadrupole electrodes which is located remotest from the second quadrupole electrode has a width greater than the other of the vertical electrode pieces of each of the first and third quadrupole electrodes which is located closest to the second quadrupole electrode, and each of the horizontal electrode pieces of each of the first and third quadrupole electrodes has a width greater than the width of said other of the vertical electrode pieces and smaller than the width of said one of the vertical electrode pieces.

34. The apparatus as claimed in claim 33, wherein each of the horizontal and vertical electrode pieces of the second quadrupole electrode has a width equal to said one of the vertical electrode pieces of each of the first and third quadrupole electrodes.

35. The apparatus as claimed in claim 28, wherein one of the vertical electrode pieces of each of the first and third quadrupole electrodes which is located remotest from the second quadrupole electrode has a width greater than the other of the vertical electrode pieces of each of the first and third quadrupole electrodes which is located closest to the second quadrupole electrode.

36. The apparatus as claimed in claim 35, wherein each of the horizontal electrode pieces of each of the first and second quadrupole electrodes has a width greater than that of each of the horizontal electrode pieces of the second quadrupole electrode.

37. The apparatus as claimed in claim 36, wherein each of the vertical electrode pieces of the second quadrupole electrode has a width greater than said other of the vertical electrode pieces of each of the first and third quadrupole electrodes and smaller than that of said one of the vertical electrode pieces of each of the first and third quadrupole electrodes.

38. The apparatus as claimed in claim 1, wherein each of the apertures defined in the focusing electrode is of a generally elliptical shape.

39. The apparatus as claimed in claim 38, wherein each of the generally elliptical apertures in the focusing electrode has its long axis lying in the second direction, and wherein the radius of curvature of each of the apertures in the focusing electrode which are aligned with the first and third quadrupole electrodes is greater than that of the aperture in the focusing electrode which is aligned with the second quadrupole electrode.

40. The apparatus as claimed in claim 39, wherein each of the apertures in the focusing electrode which are aligned with the first and third quadrupole electrodes has a straight edge portion extending perpendicular to the first direction and located remotest from the aperture in the focusing electrode which is aligned with the second quadrupole electrode.

41. The apparatus as claimed in claim 39, wherein each of the apertures in the focusing electrode which are aligned with the first and third quadrupole electrodes has a generally semicircular edge portion located remotest from the aperture in the focusing electrode which is aligned with the second quadrupole electrode.

42. A cathode ray tube apparatus comprising;

three cathodes linearly arranged with each other in a first direction;

a first focusing electrode positioned in alignment with the cathode;

A second focusing electrode positioned on one side of the first focusing electrode remote from the cathode in alignment with the first focusing electrode;

a quadrupole electrode structure positioned between the first and second focusing electrodes in alignment therewith and including first, second and third quadrupole electrodes, one for each electron beam, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to the associated electron beam, each of said horizontal and vertical electrode pieces being in platelike form elongated along the respective electron beams; and power source means for applying a predetermined focusing voltage to both of the first and second focusing electrodes and also for applying a modulating voltage between the horizontal electrode pieces and the vertical electrode pieces of the quadrupole electrode, said modulating voltage being synchronized with a deflection period.

43. The apparatus as claimed in claim 42, wherein the power source means comprises a high voltage generating circuit for generating an anode voltage, a divider circuit for dividing the anode voltage, a first output terminal from which a first direct current voltage drawn from the divider circuit is extracted, a second output terminal from which a second direct current voltage drawn from the divider circuit through a resistor of high resistance value is extracted, a modulating voltage source for generating the modulating voltage synchronized with the deflection period, and a capacitor connected between the modulating voltage source and the resistor of high resistance value.

44. The apparatus as claimed in claim 43, wherein the divider circuit includes a first variable resistor connected electrically with the first output terminal.

45. The apparatus as claimed in claim 44, wherein the divider circuit includes a second variable resistor connected electrically with the resistor of high resistance value.

46. The apparatus as claimed in claim 45, wherein the first and second variable resistors are connected parallel to each other.

47. The apparatus as claimed in claim 42, wherein the modulating voltage is a voltage of generally parabolic waveform.

48. The apparatus as claimed in claim 42, wherein one of the horizontal and vertical electrode members of the quadrupole electrode is electrically connected with one of the first and second focusing electrode.

49. The apparatus as claimed in claim 48, wherein the first and second focusing electrodes are electrically connected with each other.

50. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes being comprised of a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, said power source means including a modulating voltage source for generating a modulating voltage synchronized with a deflection period of the electron beams, the modulating voltage generated from the modulating voltage source being a voltage having a parabolic waveform required to correct a deflection aberration of the electron beams, the modulating voltage from the modulating voltage source being applied between the horizontal electrode pieces and the vertical electrode pieces of the quadrupole electrode structure, one of the horizontal electrode pieces and the vertical electrode pieces of the quadrupole electrode structure being electrically connected with the focusing electrode and the other of the horizontal electrode pieces and the vertical electrode pieces of the quadrupole electrode structure being electrically connected with the modulation voltage source.

51. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, said power source means including a modulating voltage source for generating a modulating voltage synchronized with a deflection period of the electron beams, the modulating voltage generated from the modulating voltage source being a voltage having a parabolic waveform required to correct a deflection aberration of the electron beams, the modulating voltage from the modulating voltage source being applied between the horizontal electrode pieces and the vertical electrode pieces of the quadrupole electrode structure, one of the horizontal electrode pieces and the vertical electrode pieces of the quadrupole electrode structure being electrically connected with the focusing electrode and adapted to receive a first modulating voltage from the power source means and the other of the horizontal electrode pieces and the vertical electrode pieces of the quadrupole electrode structure being adapted to receive a second modulating voltage from the power source means.

52. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, said power source means including a modulating voltage source for generating a modulating voltage synchronized with a deflection period of the electron beams, the modulating voltage generated from the modulating voltage source being a voltage having a parabolic waveform required to correct a deflection aberration of the electron beams, the modulating voltage from the modulating voltage source being applied between the horizontal electrode pieces and the vertical electrode pieces of the quadrupole electrode structure, the vertical electrode pieces of the quadrupole electrode structure are electrically connected with the focusing electrode and the horizontal electrode pieces of the same quadrupole electrode structure are applied with the modulating voltage to form a uni-potential focusing lens.

53. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, said power source means including a modulating voltage source for generating a modulating voltage synchronized with a deflection period of the electron beams, the modulating voltage generated from the modulating voltage source being a voltage having a parabolic waveform required to correct a deflection aberration of the electron beams, the modulating voltage from the modulating voltage source being applied between the horizontal electrode pieces and the vertical electrode pieces of the quadrupole electrode structure, the horizontal electrode pieces of the quadrupole electrode structure are electrically connected with the focusing electrode and adapted to receive the modulating voltage, and the vertical electrode pieces of the quadrupole electrode structure are adapted to receive a predetermined direct current voltage.

54. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, said power source means including a modulating voltage source for generating a modulating voltage synchronized with a deflection period of the electron beams, the modulating voltage generated from the modulating voltage source being a voltage having a parabolic waveform required to correct a deflection aberration of the electron beams, the modulating voltage from the modulating voltage source being applied between the horizontal electrode pieces and the vertical electrode pieces of the quadrupole electrode structure, the horizontal electrode pieces and the vertical electrode pieces of the quadrupole electrode structure are electrically connected with each other through a resistor, and wherein one of the horizontal electrode pieces and the vertical electrode pieces of the quadrupole electrode structure is adapted to receive a first direct current voltage and the other of the horizontal electrode pieces and the vertical electrode pieces of the quadrupole electrode structure is adapted to receive a second direct current voltage through said resistor, said modulating voltage being applied between the horizontal electrode pieces and the vertical electrode pieces of the quadrupole electrode structure through a capacitor.

55. A cathode ray tube apparatus comprising;

three cathodes linearly arranged with each other in a first direction for emission of respective electron beams therefrom;

a focusing electrode having first, second and third apertures defined therein for the passage of the respective electron beams therethrough;

a quadrupole electrode structure including first, second and third quadrupole electrodes, one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beam; and power source means for applying a predetermined voltage to the quadrupole electrode structure, the second quadrupole electrode positioned intermediately between the first and third quadrupole electrodes has a shape different from that of any one of the first and third quadrupole electrodes.

56. A cathode ray tube apparatus comprising:

three cathodes linearly arranged with each other in a first direction for emission of respective electron beams therefrom;

a focusing electrode having first, second and third apertures defined therein for the passage of the respective electron beams therethrough, each of the apertures defined in the focusing electrode being of a generally elliptical shape;

a quadrupole electrode including first, second and third quadrupole electrodes one for each electron beams, each of said quadrupole electrodes including, a pair of horizontal electrode pieces spaced a predetermined distance from each other in a second direction perpendicular to the first direction and positioned upwardly and downwardly, respectively, with respect to the associated electron beam, and a pair of vertical electrode pieces spaced a predetermined distance from each other in a direction aligned with the first direction and positioned leftwards and rightwards with respect to such associated electron beams; and power source means for applying a predetermined voltage to the quadrupole electrode structure, each of the generally elliptical apertures in the focusing electrode having a long axis lying in the second direction, and wherein the radius of curvature of each of the apertures in the focusing electrode which are aligned with the first and third quadrupole electrodes is greater than that of the aperture in the focusing electrode which is aligned with the second quadrupole electrode.

57. A cathode ray tube apparatus comprising:

at least one cathode;

a first focusing electrode positioned in alignment with the cathode;

a second focusing electrode positioned on one side of the first focusing electrode remote from the cathode in alignment with the first focusing electrode;

a quadrupole electrode structure positioned between the first and second focusing electrodes in alignment therewith and including at least one quadrupole electrode having a horizontal electrode member and a vertical member; and power source means for applying a predetermined voltage to both of the first and second focusing electrodes and also for applying a modulating voltage between the horizontal electrode member and the vertical electrode member of the quadrupole electrode, said modulating voltage being synchronized with a deflection period, the quadrupole electrode structure, the power source means comprises a high voltage generating circuit for generating an anode voltage, a divider circuit for dividing the anode voltage, a first output terminal from which a first direct current voltage drawn from the divider circuit is extracted, a second output terminal from which a second direct current voltage drawn from the divider circuit through a resistor of high resistance value is extracted, a modulating voltage source for generating the modulating voltage synchronized with the deflection period, and a capacitor connected between the modulating voltage source and the resistor of high resistance value.

58. A cathode ray tube apparatus comprising:

at least one cathode;

a first focusing electrode positioned in alignment with the cathode;

a second focusing electrode positioned on one side of the first focusing electrode remote from the cathode in alignment with the first focusing electrode;

a quadrupole electrode structure positioned between the first and second focusing electrodes in alignment therewith and including at least one quadrupole electrode having a horizontal electrode member and a vertical member, one of the horizontal and vertical electrode members of the quadrupole electrode being electrically connected with one of the first and second focusing electrodes; and power source means for applying a predetermined voltage to both of the first and second focusing electrodes and also for applying a modulating voltage between the horizontal electrode member and the vertical electrode member of the quadrupole electrode, said modulating voltage being synchronized with a deflection period.

* * * * *